US009782012B2

(12) United States Patent
Zimmer

(10) Patent No.: US 9,782,012 B2
(45) Date of Patent: Oct. 10, 2017

(54) CONCEALABLE BED SYSTEM

(71) Applicant: John Zimmer, Brooklyn, NY (US)

(72) Inventor: John Zimmer, Brooklyn, NY (US)

( * ) Notice: Subject to any disclaimer, the term of this patent is extended or adjusted under 35 U.S.C. 154(b) by 0 days.

(21) Appl. No.: 13/969,498

(22) Filed: Aug. 16, 2013

(65) Prior Publication Data

US 2014/0047638 A1 Feb. 20, 2014

Related U.S. Application Data

(60) Provisional application No. 61/683,746, filed on Aug. 16, 2012.

(51) Int. Cl.

| | |
|---|---|
| ***A47B 83/00*** | (2006.01) |
| ***A47D 11/00*** | (2006.01) |
| ***A47C 17/52*** | (2006.01) |
| ***A47C 17/58*** | (2006.01) |
| ***A47C 17/62*** | (2006.01) |

(52) U.S. Cl.

CPC ..... *A47C 17/52* (2013.01); *A47C 17/58* (2013.01); *A47C 17/62* (2013.01)

(58) Field of Classification Search

CPC ..... A47C 17/52; A47C 17/62; A47C 17/58
USPC ..... 5/2.1, 3, 6, 12.1, 18.1; 312/334.41, 312/348.1, 334.27

See application file for complete search history.

(56) References Cited

U.S. PATENT DOCUMENTS 1,344,257 A * 6/1920 Block ..... A47C 17/58 5/143
1,383,485 A 7/1921 Richardson
1,402,432 A * 1/1922 Monger ..... A47C 17/52 5/131
1,562,205 A * 11/1925 Chempanos ..... 5/2.1
1,776,286 A * 9/1930 Wladyslaw ..... A47C 17/225 5/1
2,127,025 A * 8/1938 Mckeithan ..... A47C 17/58 5/182
2,313,813 A 3/1943 Ebbert
2,544,762 A * 3/1951 Lochridge ..... 5/6
2,628,371 A 2/1953 Null
3,416,168 A 12/1968 Pokomy
3,475,769 A 11/1969 Fasanella
3,638,249 A * 2/1972 Katsigarakis ..... 5/159.1
3,965,498 A * 6/1976 Boni ..... 5/6
4,253,205 A 3/1981 Mikos
4,509,216 A 4/1985 Blevins
4,793,011 A * 12/1988 Eve ..... 5/136
(Continued)

*Primary Examiner* — David E Sosnowski
(74) *Attorney, Agent, or Firm* — John Laurence

(57) ABSTRACT

Several embodiments of a new concealable bed system, which comprises a new combination of a folding bed assembly (112), a drawer assembly (110), and a drawer support-and-control assembly (120)are disclosed. The embodiments allow the space-savings and convenience of sleeper sofas to be extended to a wide variety of other furniture types or other constructions, including but not limited to desks, entertainment centers, cabinets, closets, etc. In the closed position, the embodiments can look like any other drawer in a piece of furniture, custom millwork, etc., but when opened the folding bed assembly is exposed and can be easily deployed. Thus the new concealable bed system provides a more efficient, durable, and flexible option for concealing a bed than sleeper sofas, Murphy beds, trundle beds, roll-away beds, or inflatable beds.

7 Claims, 27 Drawing Sheets

(56) References Cited

U.S. PATENT DOCUMENTS

Figure 1A:
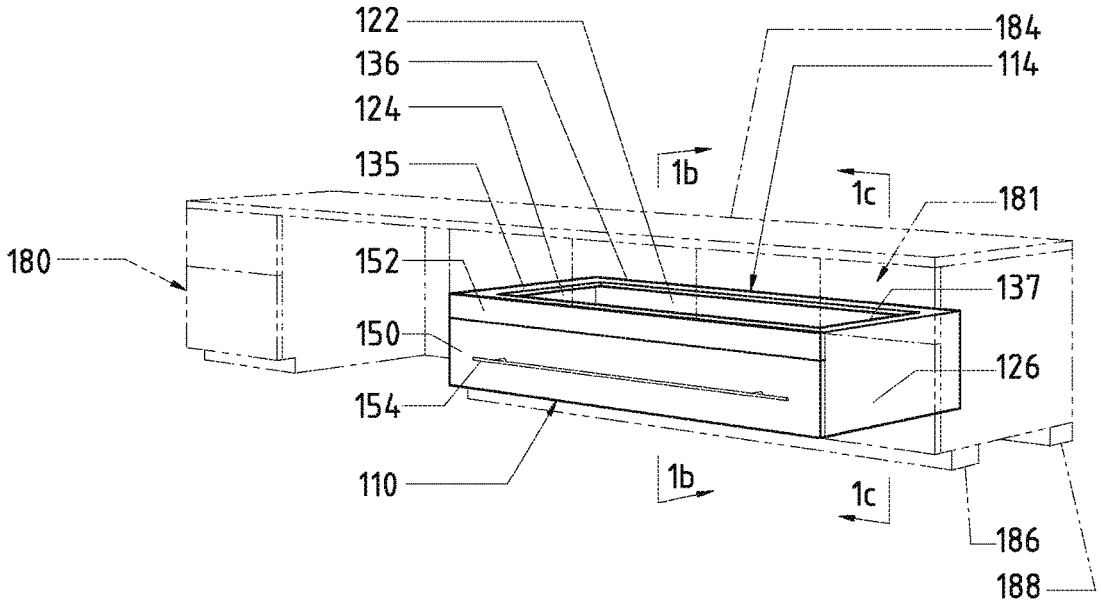

| | | | | |
|---|---|---|---|---|
| 4,999,865 | A * | 3/1991 | Sauder et al. | 5/149 |
| 5,400,447 | A | 3/1995 | Porkomy | |
| 5,440,768 | A * | 8/1995 | Danin | 5/4 |
| 5,893,182 | A * | 4/1999 | Sutherland | A47C 13/00 297/105 |
| 5,913,769 | A * | 6/1999 | Byma et al. | 5/2.1 |
| 6,425,151 | B2 | 7/2002 | Barnett | |
| 6,463,603 | B1 * | 10/2002 | Camfield | 5/18.1 |
| 8,091,159 | B2 | 1/2012 | Harris | |
| 8,572,776 | B2 * | 11/2013 | Grubb | 5/152 |
| 2004/0093669 | A1 * | 5/2004 | Arason et al. | 5/159.1 |
| 2006/0225210 | A1 * | 10/2006 | Arason et al. | 5/159.1 |
| 2007/0214567 | A1 * | 9/2007 | Wandel | A47B 83/04 5/3 |
| 2012/0073045 | A1 * | 3/2012 | Grubb | 5/136 |

* cited by examiner

CONCEALABLE BED SYSTEM

CROSS-REFERENCE TO RELATED APPLICATIONS

This non-provisional application claims the benefit of provisional patent application No. 61/683,746, filed 2012 Aug. 16 by the present inventor.

BACKGROUND

There are a variety of concealable beds that can be quickly and conveniently stored out of sight. Some that are well-known and widely used today include Murphy beds, sleeper sofas, trundle beds, convertible futons, roll-away beds, and inflatable beds. While each of these provides a certain level of convenience, each also has its drawbacks, as enumerated below, a) Murphy Beds. A problem with Murphy beds is that they are not compact. In the stored position, they take up a large amount of wall or closet space that might otherwise be available for windows, countertops, storage, artwork, wall cabinets, or other items, b) Sleeper Sofas. A problem with sleeper sofas is that in order to provide the concealable bed, one must have the sofa. In many situations one might wish to have a concealable bed without a sofa, such as in home offices, bedrooms, etc. Another problem is that the design options of sleeper sofas are limited—one might rather have a more elegant sofa, and then accommodate the concealable bed in some other article of furniture.

c) Trundle Beds. A problem with trundle beds is that on their own they provide only a twin-sized mattress, rather than the full-sized (or larger) mattress provided by a typical Murphy or sleeper sofa. Although a trundle beds can work together with a fixed twin beds to create the equivalent of one full-sized mattress, this limits its use to bedrooms.

d) Convertible Futons. Convertible futons have the same problem as sleeper sofas. See paragraph "b" above.

e) Rollaway Beds. A problem with rollaway beds (and folding cots) is that they are heavy and awkward to move from room to room. Another problem is that they require a closet or room to store them in, which may not be available or which one might rather use for other purposes.

f) Inflatable Beds. A problem with inflatable beds is that they are not durable, and are easily damaged by accidental punctures. Another problem is that they can be cold and/or squeaky.

In addition to the commonly known concealable beds listed above, there have also been a myriad of lesser-known efforts to hide beds in other furniture. These have generally attempted to fold, tilt, swing, or slide some manner of customized collapsible bed into some manner of customized wardrobe, credenza, desk, or cabinet. A sample includes patents U.S. Pat. No. 2,313,813 (the side of a desk), U.S. Pat. No. 5,400,447 (the kneewell of a desk), and U.S. Pat. No. 6,425,151 (a large free-standing cabinet). In the past, articles of this sort have suffered from one, several, or all of the following problems:

a) they are unnecessarily complex, b) they are cumbersome, c) they are impractical, d) they rely on customized construction rather than readily available, prefabricated parts, e) the beds are built into highly unique pieces of furniture that are hard to adapt to a variety of environments, and/or f) their space-savings and utility over other forms of concealed beds are nominal.

A specific case in point is George Fasanella's "Dormitory Furniture Ensemble" of 1969 (U.S. Pat. No. 3,475,769), which essentially conceals a sleeper sofa inside the bottom section of a wardrobe cabinet. Relative specifically to the provision of a concealable bed, the following list describes some, but not necessarily all, of the invention's drawbacks:

a) The sleeper sofa assembly is not readily transferrable to other designs. The high degree of customization of the sofa, its carriage, and the cabinet makes it difficult to adapt the assembly to other articles of furniture or built-in construction, limiting its utility. Examples of this include, but are not limited to, the shape of side panels 86 and 88, and custom latch assembly 124.

b) The sleeper sofa assembly is non-modular. The ensemble is constructed as one unit, using frames and panel members that rely on each other for support or are continuous from one component to the next, rather than dividing the unit into separate components, or into separate carcasses or "boxes." Examples of this include, but are not limited to, panels 218 and 242, the continuous back panel, and hat channel 226 (which is supported by, and integrated into, end frames 192 and 194).

c) The sleeper sofa assembly is not compact. Storing a concealed sofa as well as a concealed bed requires a design that is larger and more complex than would be required for a bed alone (refer to the section drawing of the "closed" ensemble, FIG. 4).

d) The bed assembly is cumbersome to access. The design forces the user to deploy the full sofa configuration before accessing the bed—one cannot go straight to the bed configuration. One must raise panel 104 and slide it into its recess, then slide the sofa forward, then pivot bolster 48 into position and engage linkage 115, and then remove and store the base cushion 50—only hen can one extend the bed.

e) The bed-and-drawer assembly is unnecessarily complex. The high number of components (including many moving parts and pieces of custom hardware) increases the risk of malfunction or failure. Examples include, but are not limited to, the following:

1. "Rail 98" (FIG. 4), which is unnecessary. The drawer could be stopped in the (properly aligned) closed position by a carcase, frame, or a simpler concealed wood or metal stop. Any commonly available furniture latch could hold the drawer in place once closed.
2. "Wheels 90" (FIG. 6), which are unnecessary. Their inclusion in combination with "guide rail assembly 80" could cause the drawer to rack, or could damage the guide rails. Heavy-duty drawer slides could support the entire weight of both the drawer and its users, even when used as a sofa.
3. "Latch Assembly 124," which is unnecessary. It is also highly customized and intricate, and therefore likely to malfunction. Its purpose, to stop the drawer in the open position, can be accommodated by modern drawer slides, many versions of which offer a "lock out" function.

Thus, there is a need for an additional type of concealable bed that provides a full-sized (or larger) mattress without a sofa, while at the same time being compact, simple, modular, easy to use, adaptable to a wide variety of conditions, and constructible from standardized, readily available parts.

SUMMARY

In accordance with one embodiment, a new concealable bed system combines a folding bed assembly with a drawer assembly and a drawer support-and-control assembly. The system allows the comfort, convenience, and compact storage of sleeper sofas to be extended to wide variety of other furniture types and other constructions.

ADVANTAGES

Accordingly several advantages of one or more aspects are as follows: to provide concealable beds that store compactly, that do not require the use of a sofa, that can be readily installed in many different rooms, that are quick and convenient to use, that are modular or otherwise easy to integrate into a wide variety of articles of furniture or other constructions, that have a familiar method of operation, that are simple to construct, and that are durable.

Thus, by combining several heretofore unrelated technologies in a novel way, a new and beneficial type of concealable bed is created. Other advantages of one or more aspects of one or more embodiments will be apparent from a consideration of the ensuing description and drawings.

DRAWINGS

FIG. 1*a* is a perspective view of one embodiment of a concealable bed system, in the fully closed position.

Figure 1B:
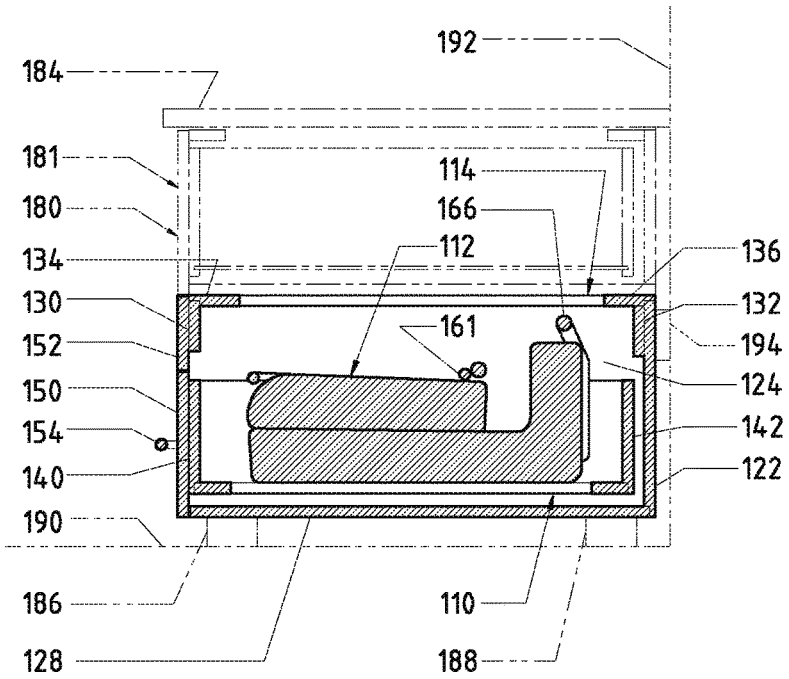

FIG. 1*b* is a sectional view of the same embodiment as FIG. 1*a*, also in the fully closed position.

Figure 1C:
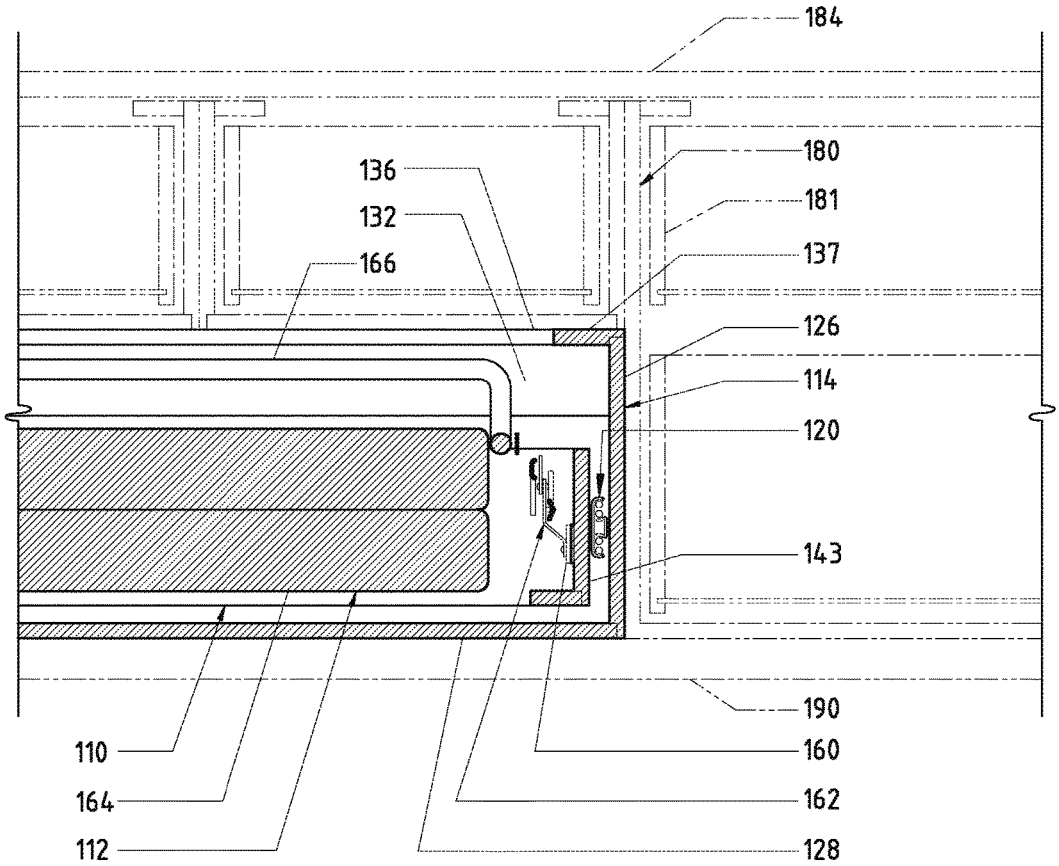
Figure 1D:
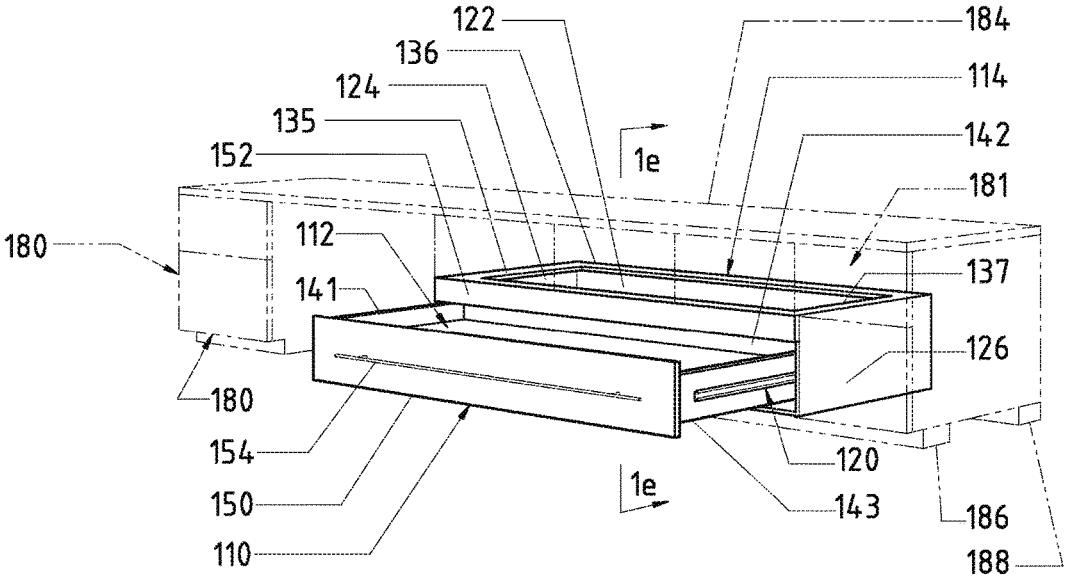
Figure 1E:
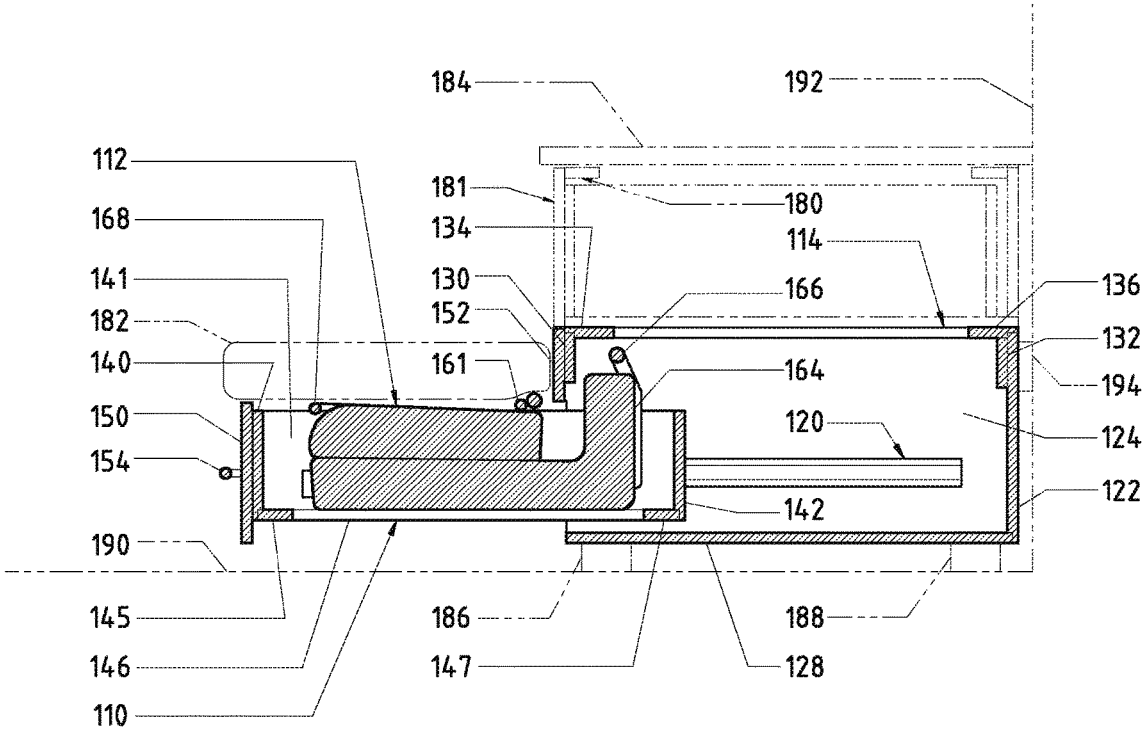

FIG. 1*e* is another sectional view of the same embodiment as FIG. 1*a*, also in the fully closed position.

FIG. 1*d* is a perspective view of the same embodiment as FIG. 1*a*, but in the partially open position.

FIG. 1*e* is a sectional view of the same embodiment as FIG. 1*a*, but in the partially open position.

Figure 1F:
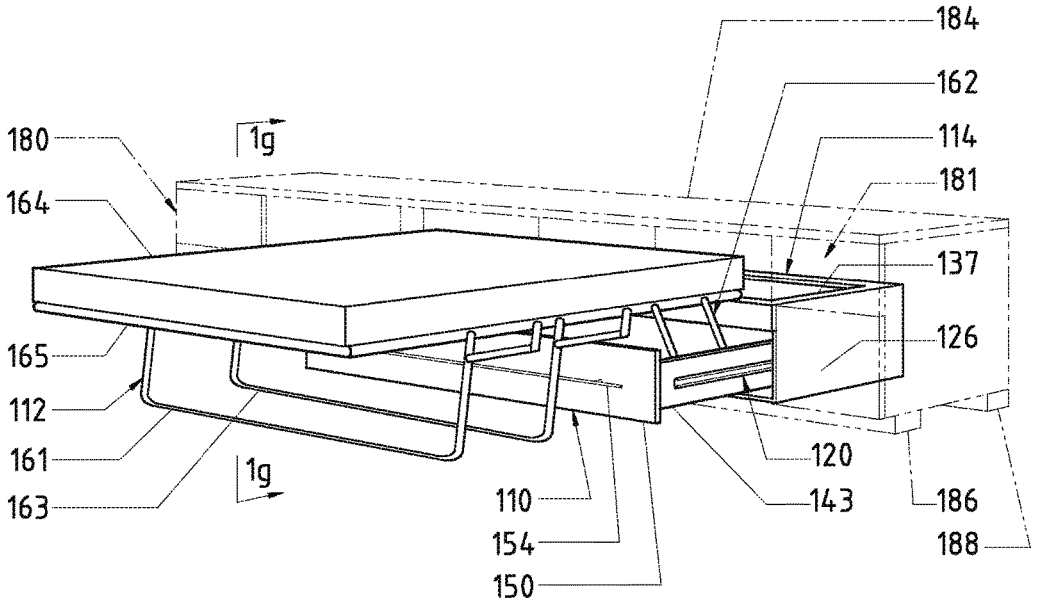

FIG. 1*f* is a perspective view of the same embodiment as FIG. 1*a*, but in the fully open position.

Figure 1G:
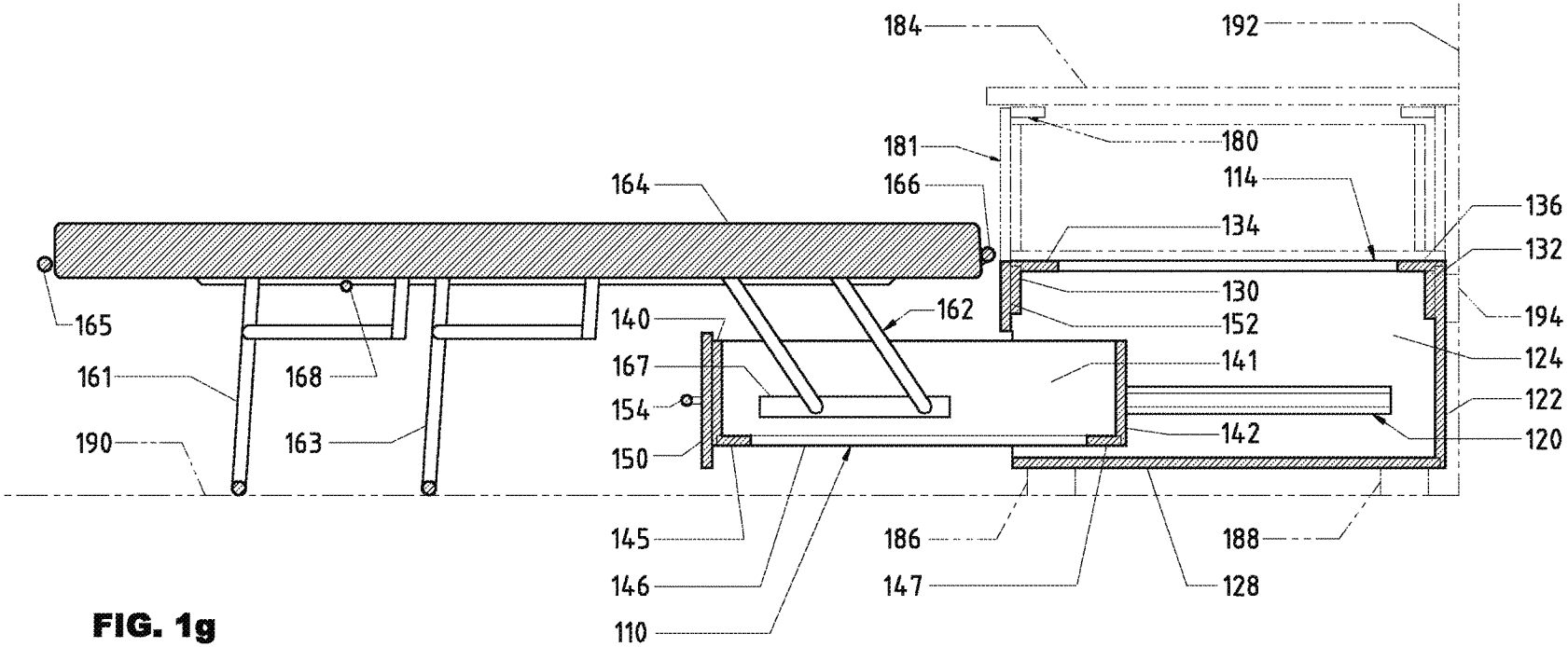
Figure 1H:
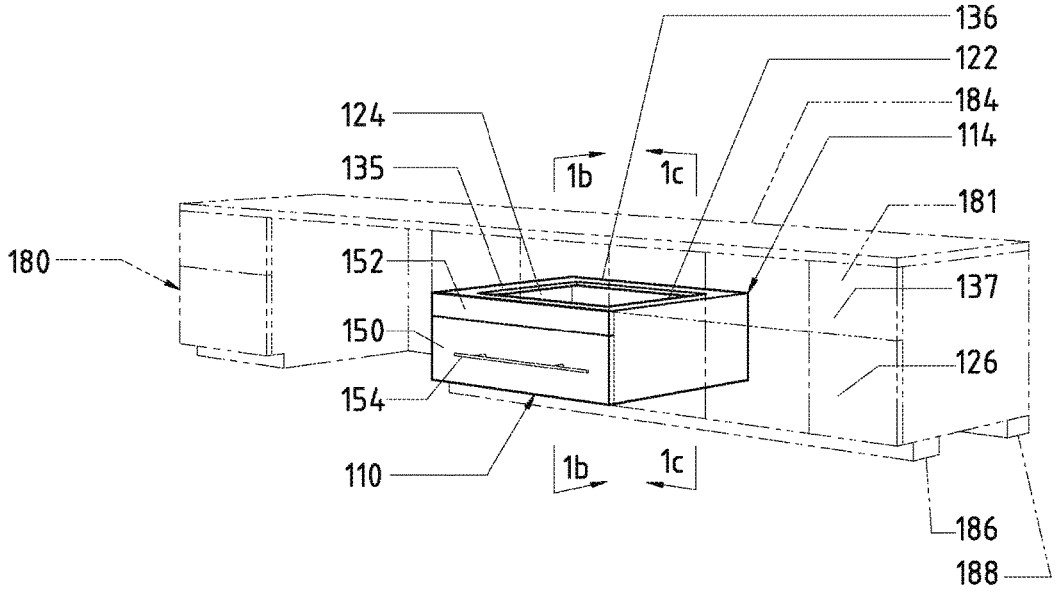

FIG. 1*g* is a sectional view the same embodiment as FIG. 1*a*, but in the fully open position FIG. 1*h* is a sectional view of an alternate version of the first embodiment, shown in the fully closed position.

Figure 1I:
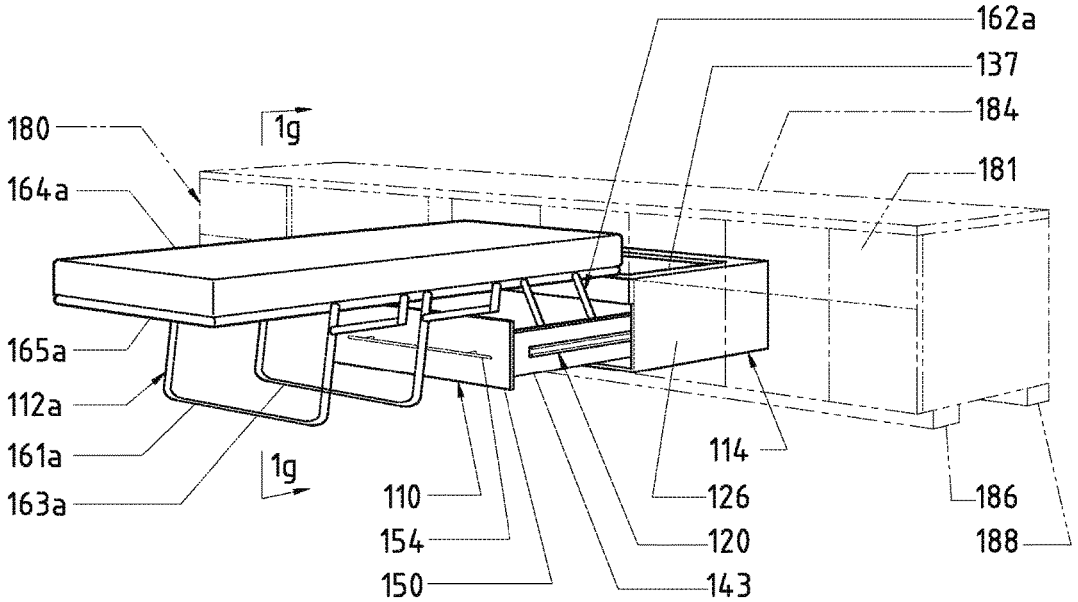

FIG. 1*i* is a perspective view of the same embodiment as FIG. 1*h*, shown in the fully open position.

Figure 1K:
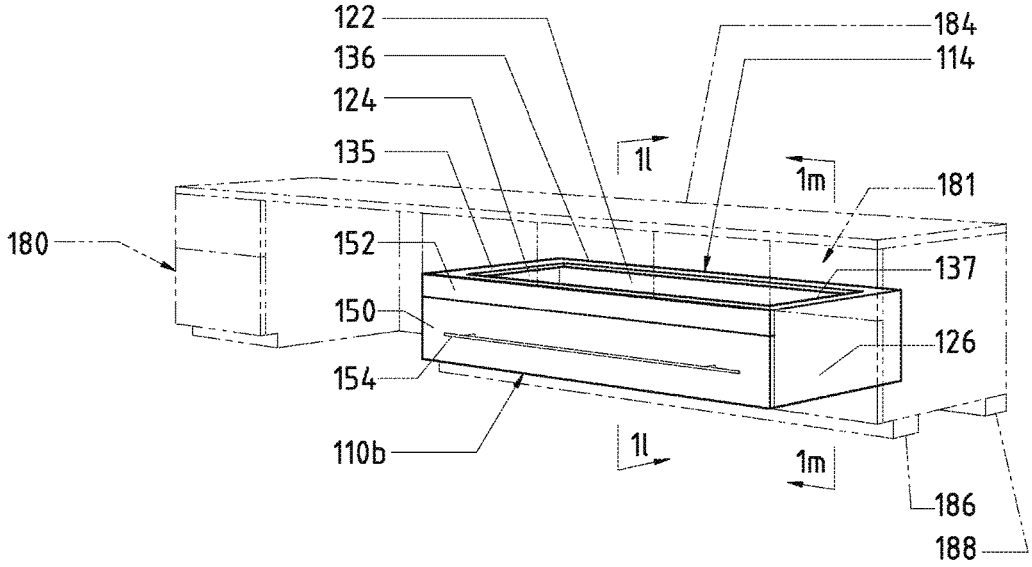

FIG. 1*k* is a perspective view of an alternate version of the first embodiment, shown in the fully closed position.

Figure 1L:
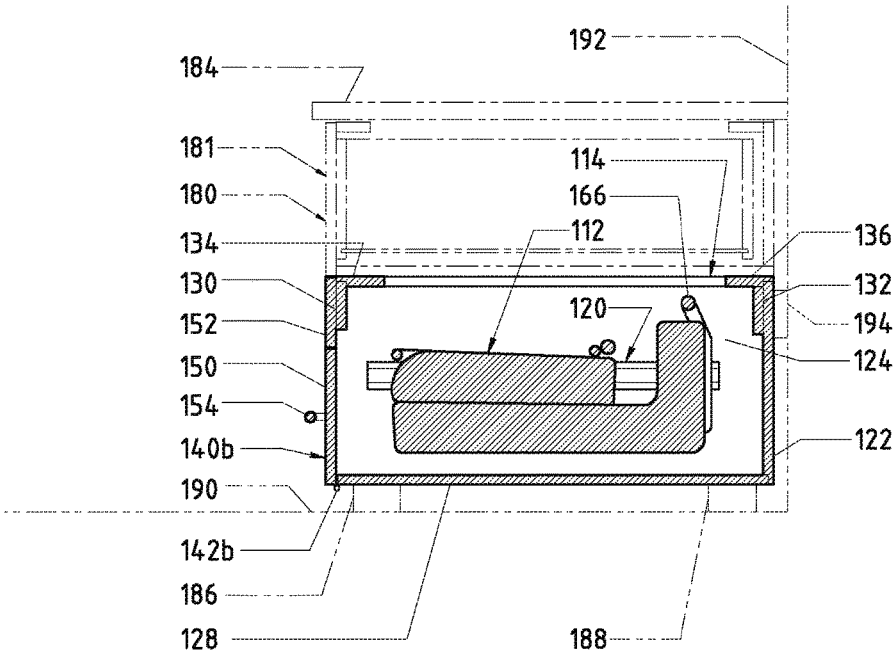

FIG. 1*l* is a sectional view of the same embodiment as FIG. 1*k*, also in the fully closed position.

Figure 1M:
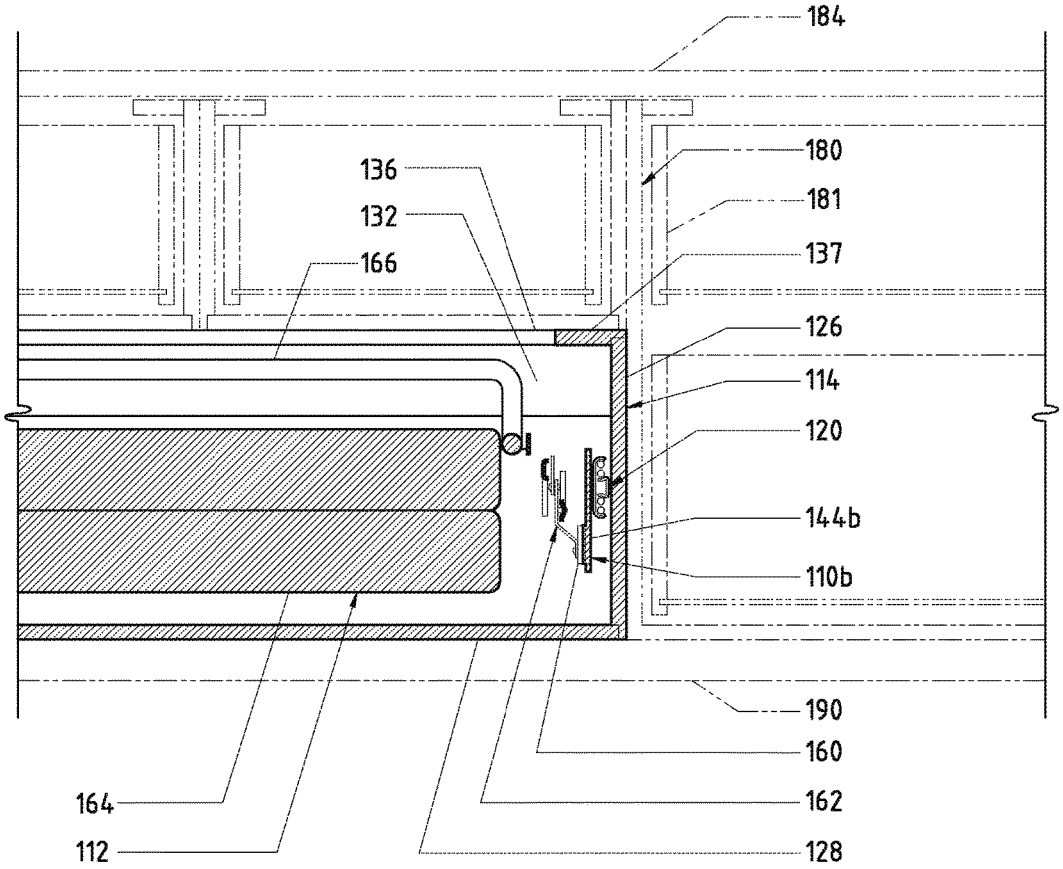

FIG. 1*m* is another sectional view of the same embodiment as FIG. 1*k*, also in the fully closed position.

Figure 1N:
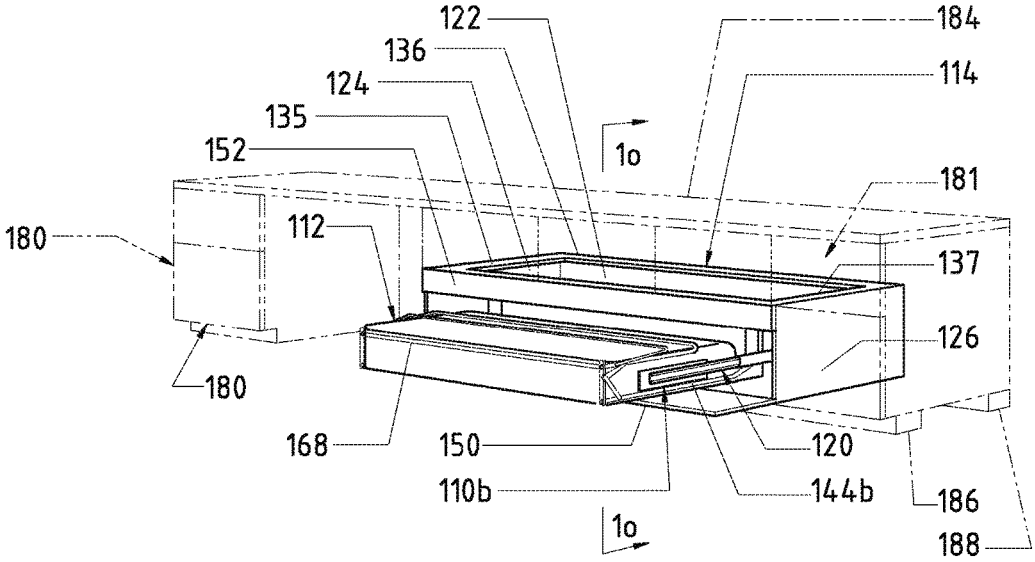

FIG. 1*n* is a perspective view of the same embodiment as FIG. 1*k*, but in the partially open position.

Figure 1O:
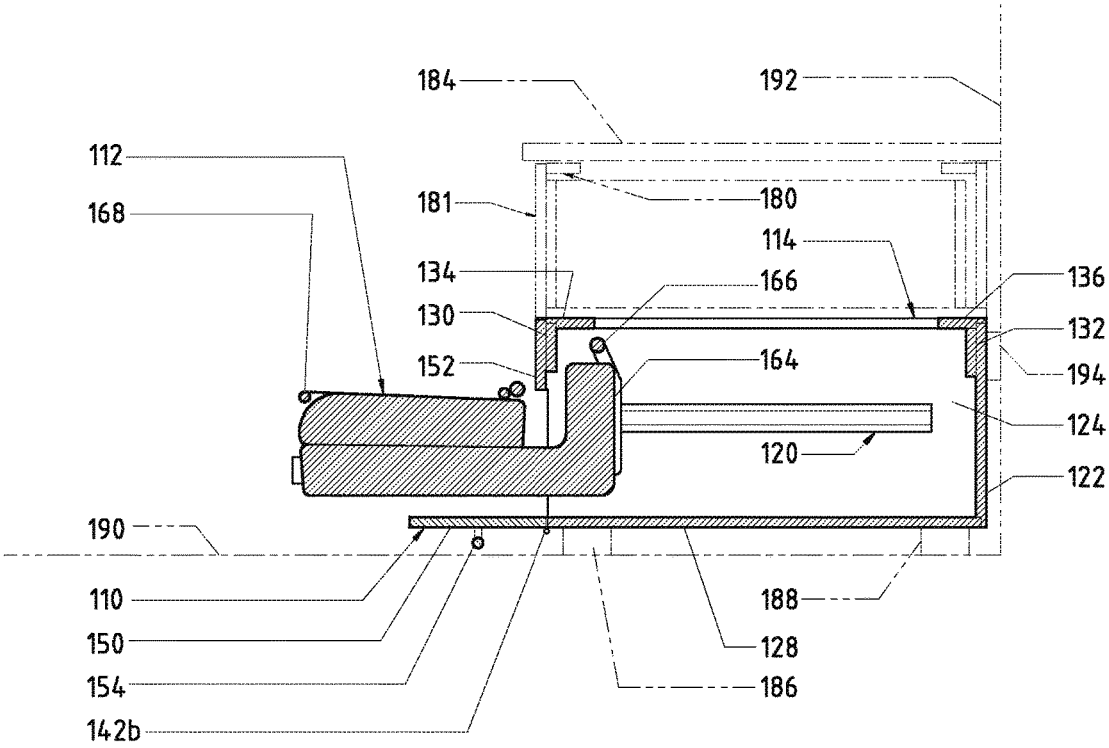

FIG. 1*o* is a sectional view of the same embodiment as FIG. 1*k*, but in the partially open position.

Figure 1P:
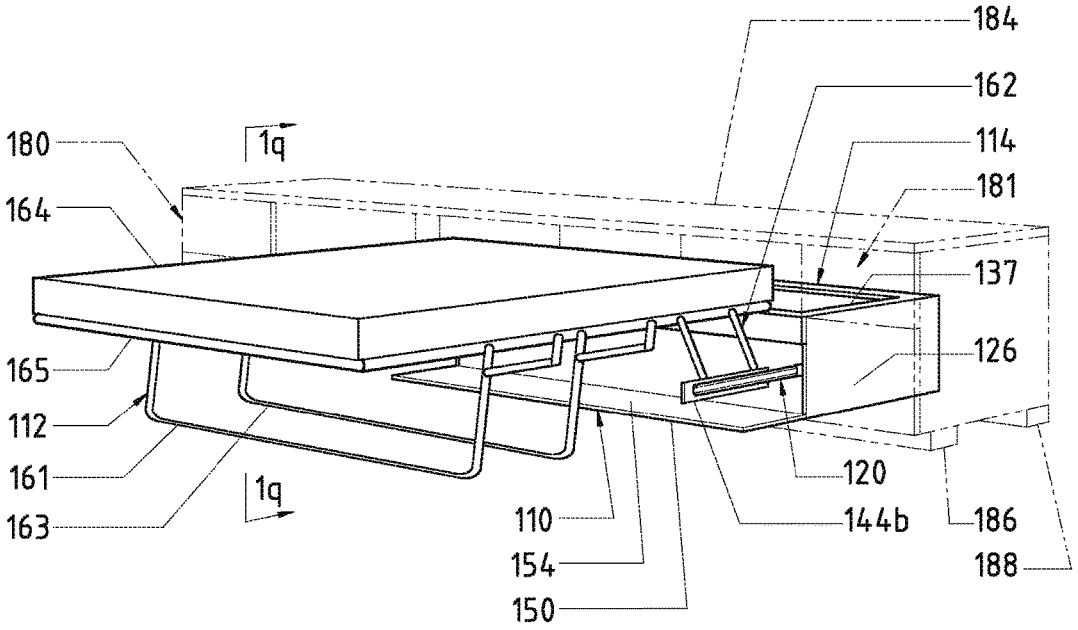

FIG. 1*p* is a perspective view of the same embodiment as FIG. 1*k*, but in the fully open position.

Figure 1Q:
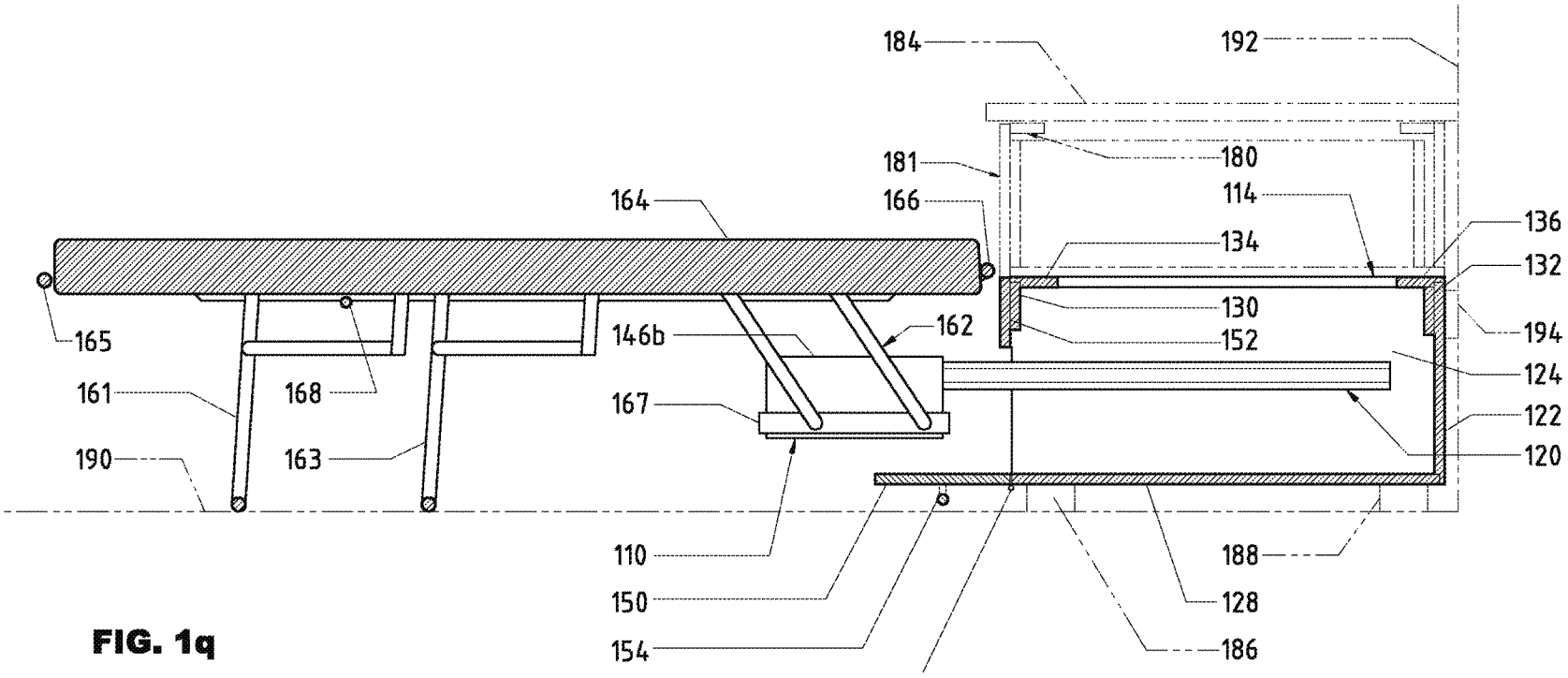

FIG. 1*q* is a sectional view the same embodiment as FIG. 1*k*, but in the fully open position.

Figure 2A:
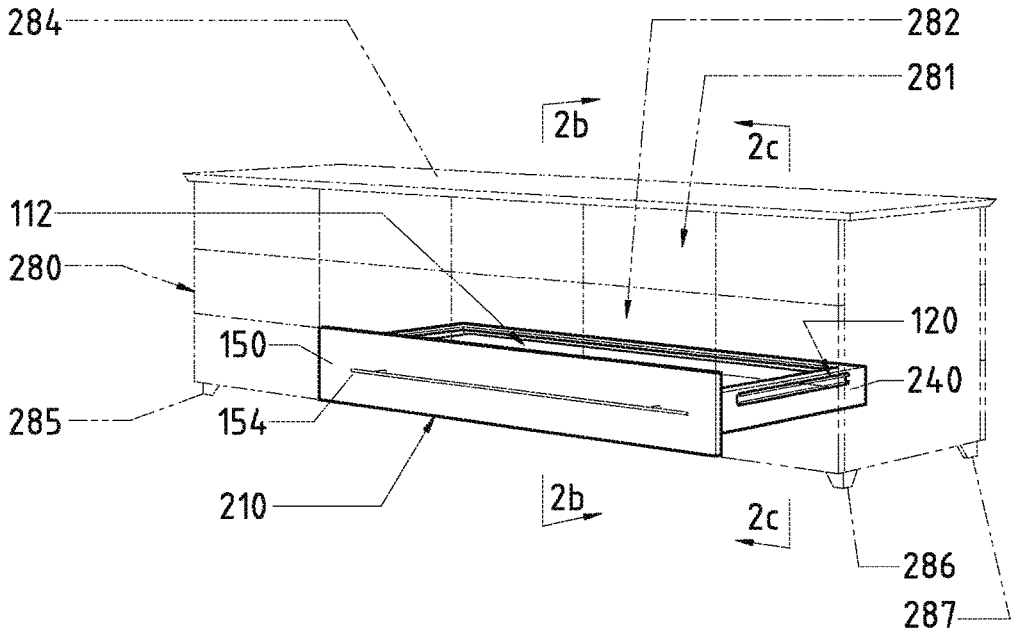

FIG. 2*a* is a perspective view of a second embodiment of a concealable bed system, shown in the fully closed position.

Figure 2B:
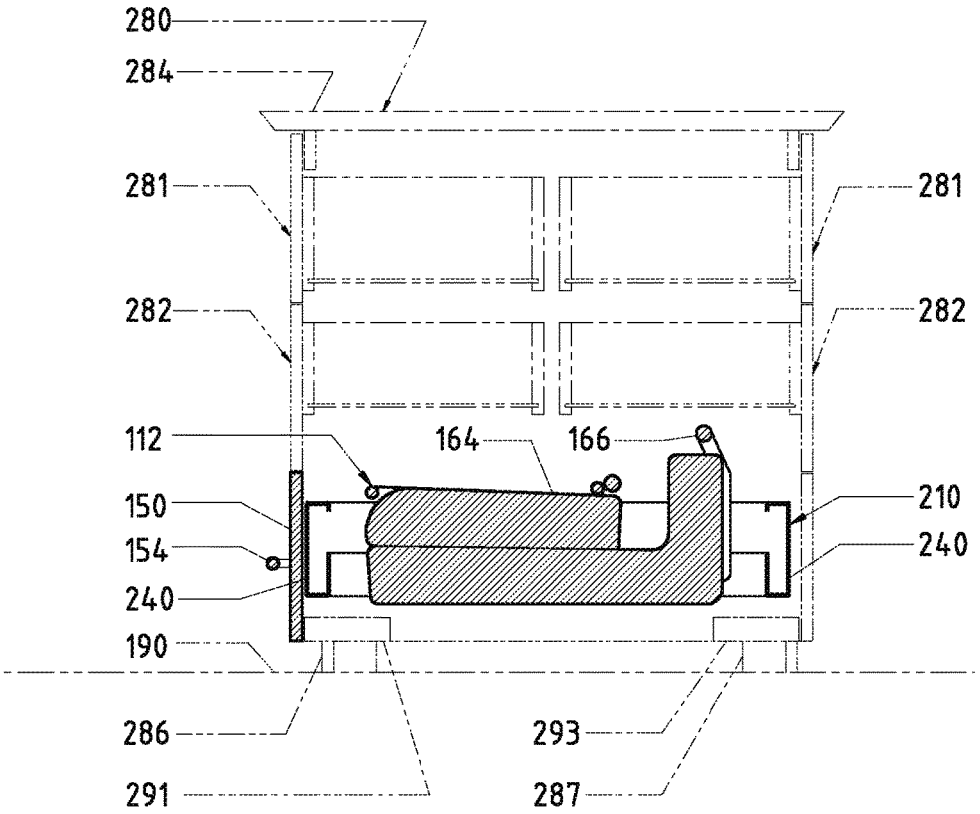

FIG. 2*b* is a sectional view of the same embodiment as FIG. 2*a*, also in the fully closed position.

Figure 2C:
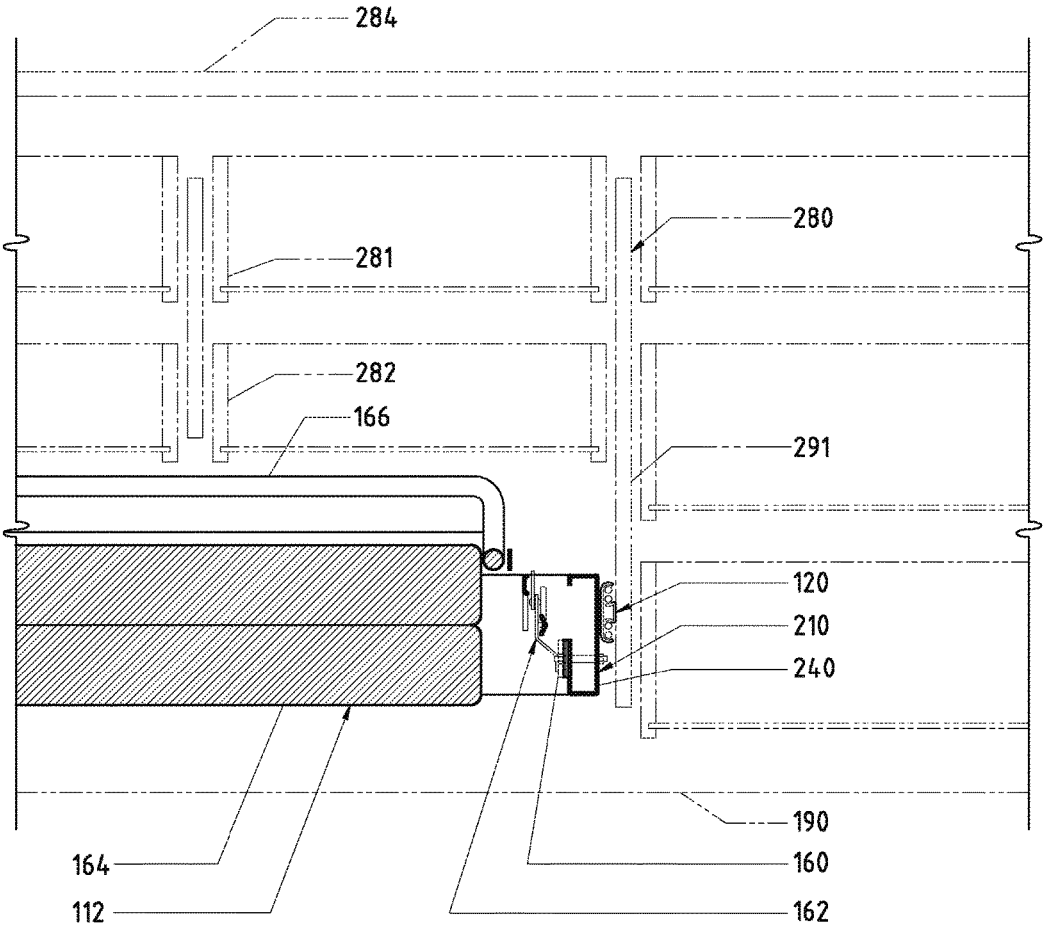

FIG. 2*c* is another sectional view of the same embodiment as FIG. 2*a*, also in the fully closed position.

Figure 2D:
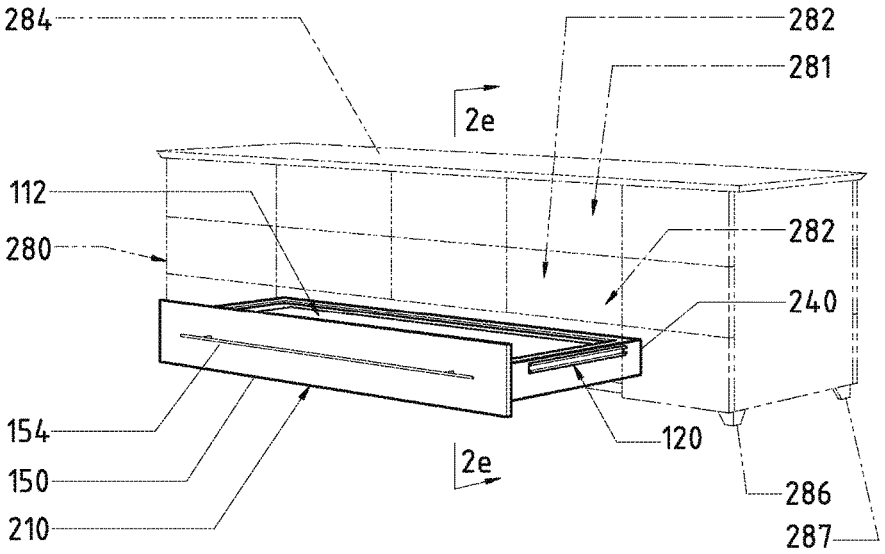

FIG. 2*d* is a perspective view of the same embodiment as FIG. 2*a*, but in the partially open position.

Figure 2E:
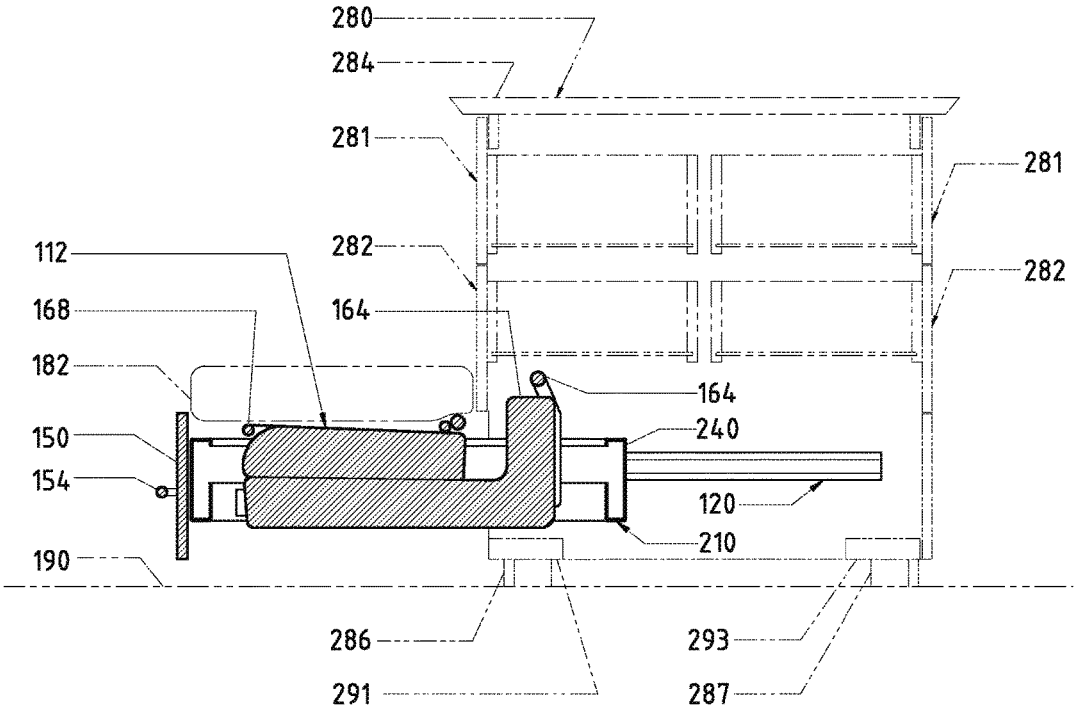

FIG. 2*e* is a sectional view of the same embodiment as FIG. 2*a*, but in the partially open position.

Figure 2F:
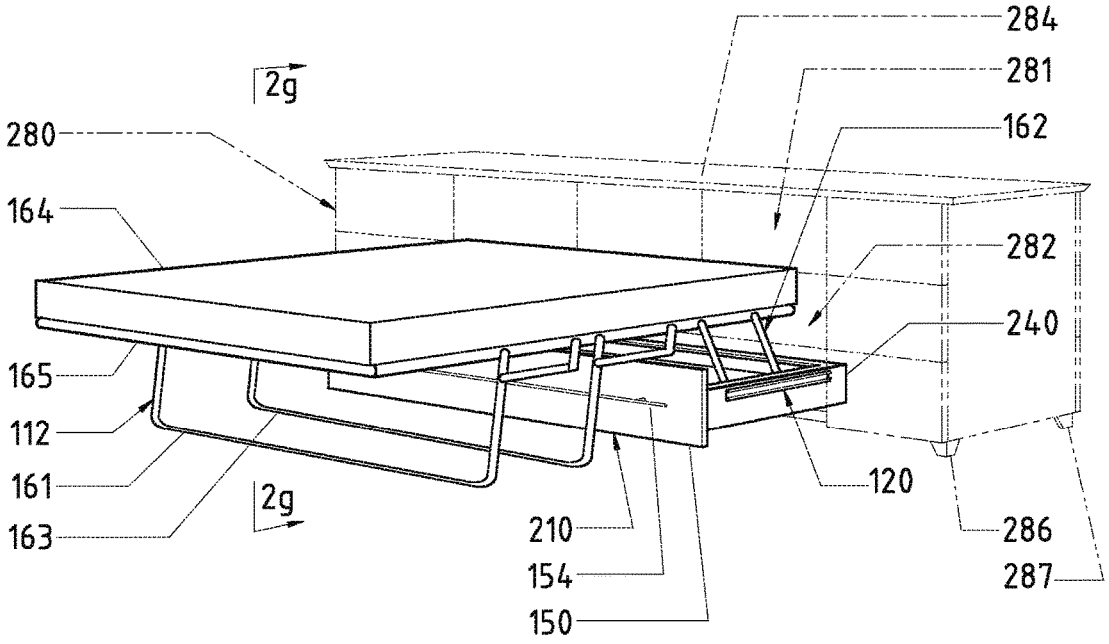

FIG. 2*f* is a perspective view of the same embodiment as FIG. 2*a*, but in the fully open position.

Figure 2G:
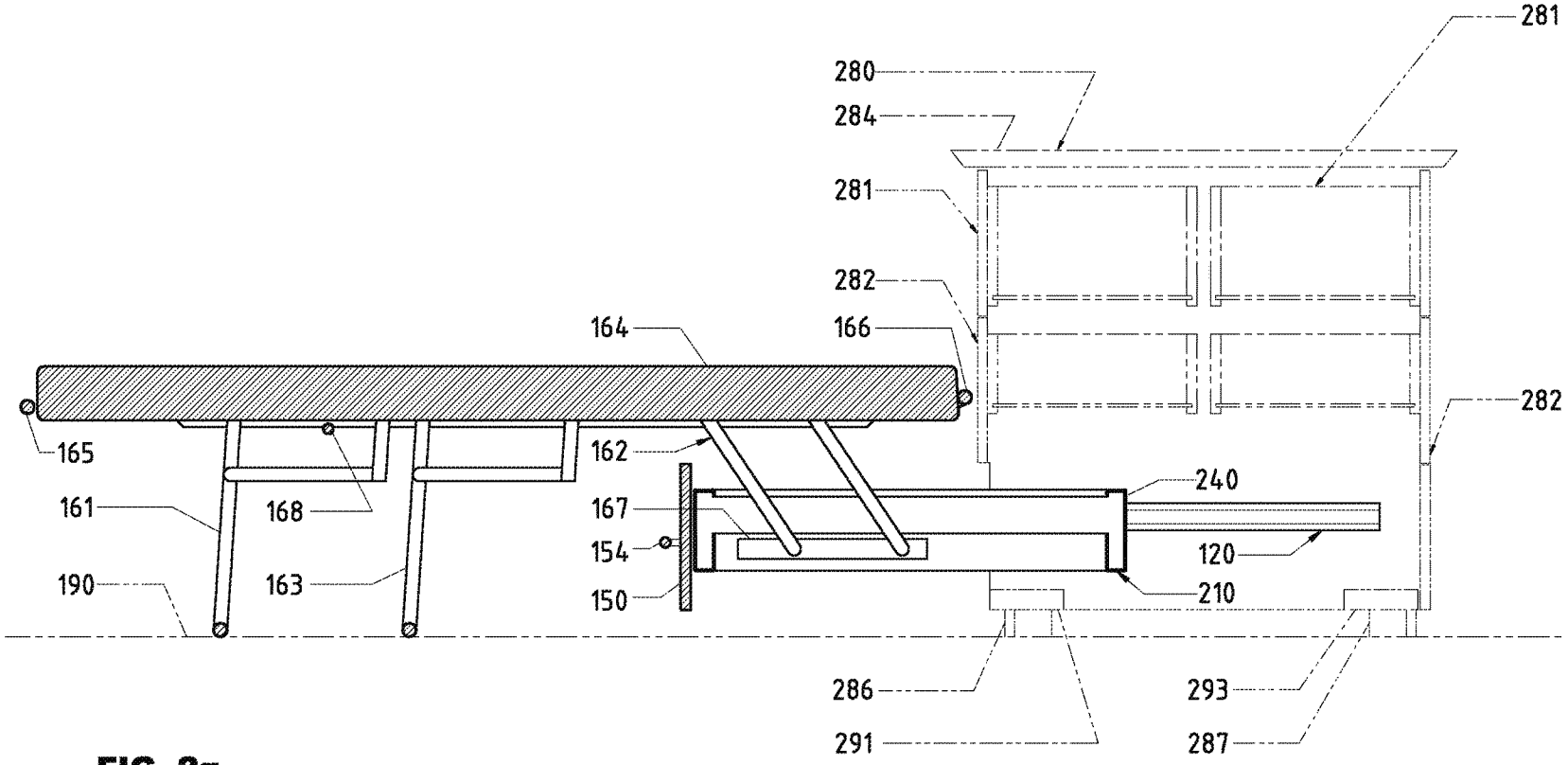
Figure 2H:
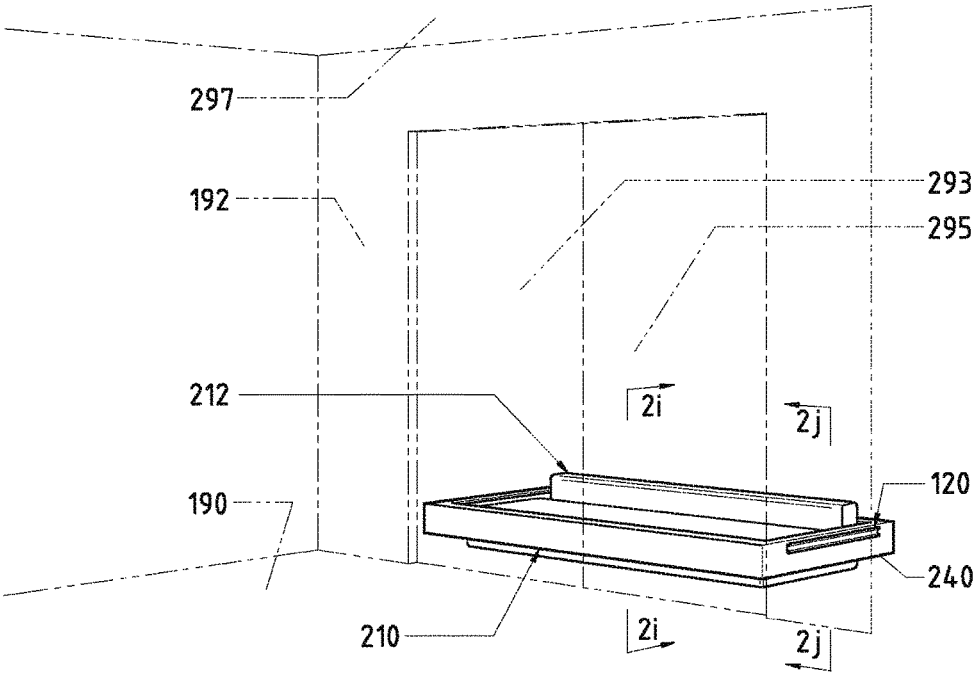

FIG. 2*g* is a sectional view the same embodiment as FIG. 2*a*, but in the fully open position FIG. 2*h* is a perspective view of an alternate version of the second embodiment, shown in the fully closed position.

Figure 2I:
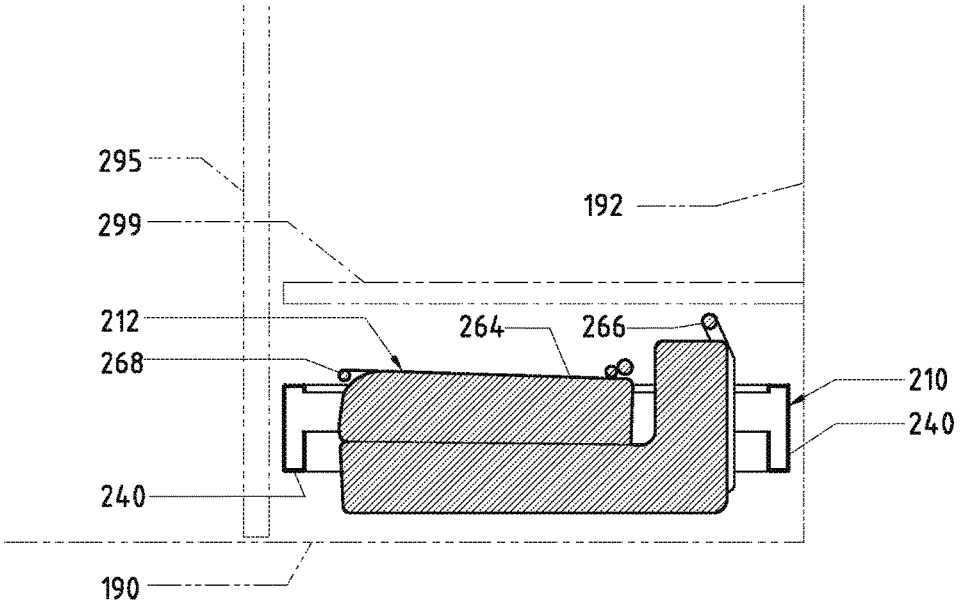

FIG. 2*i* is a sectional view of the same embodiment as FIG. 2*h*, also in the fully closed position.

Figure 2J:
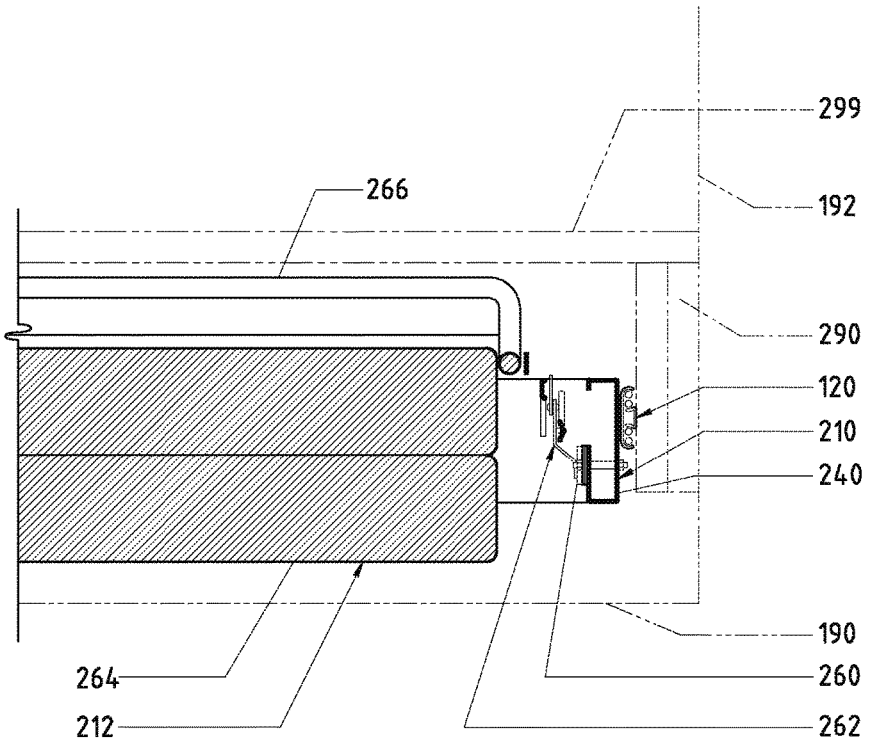

FIG. 2*j* is another sectional view of the same embodiment as FIG. 2*h*, also in the fully closed position.

Figure 2K:
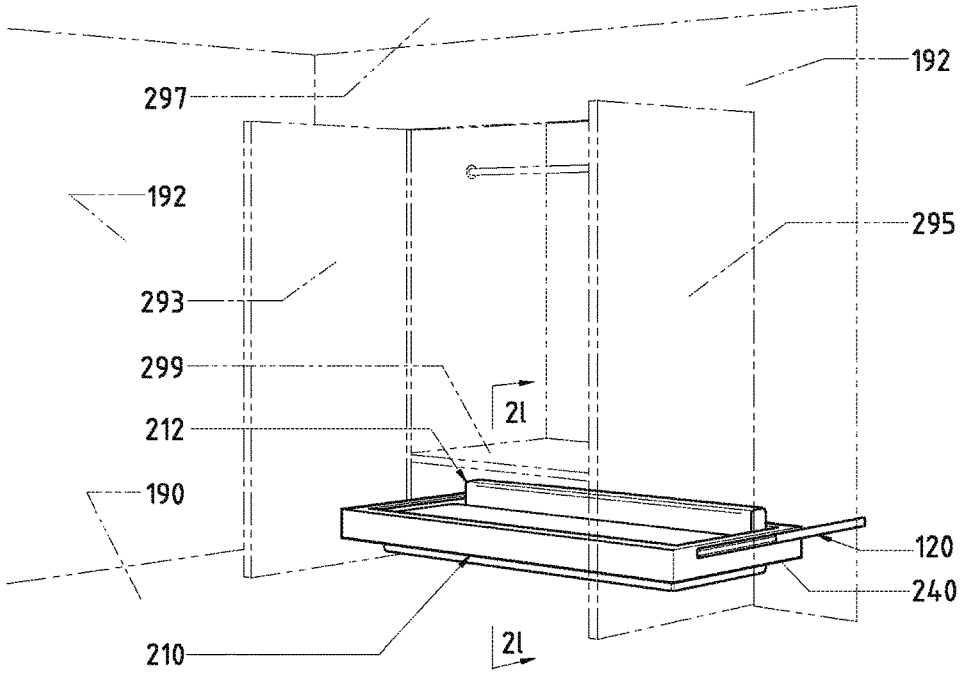

FIG. 2*k* is a perspective view of the same embodiment as FIG. 2*h*, but in the partially open position.

Figure 2L:
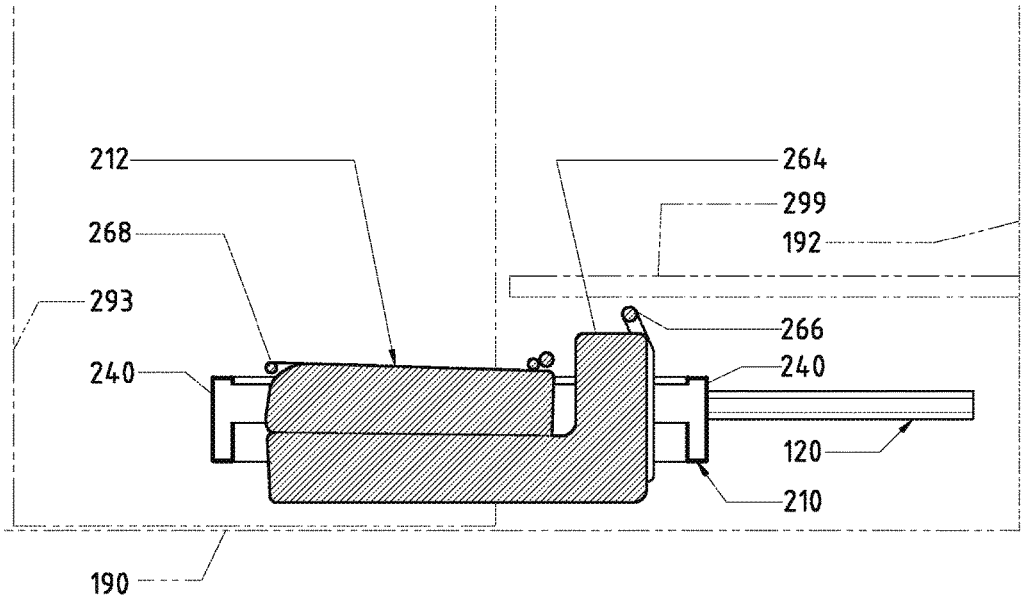

FIG. 2*l* is a sectional view of the same embodiment as FIG. 2*h*, but in the partially open position.

Figure 2M:
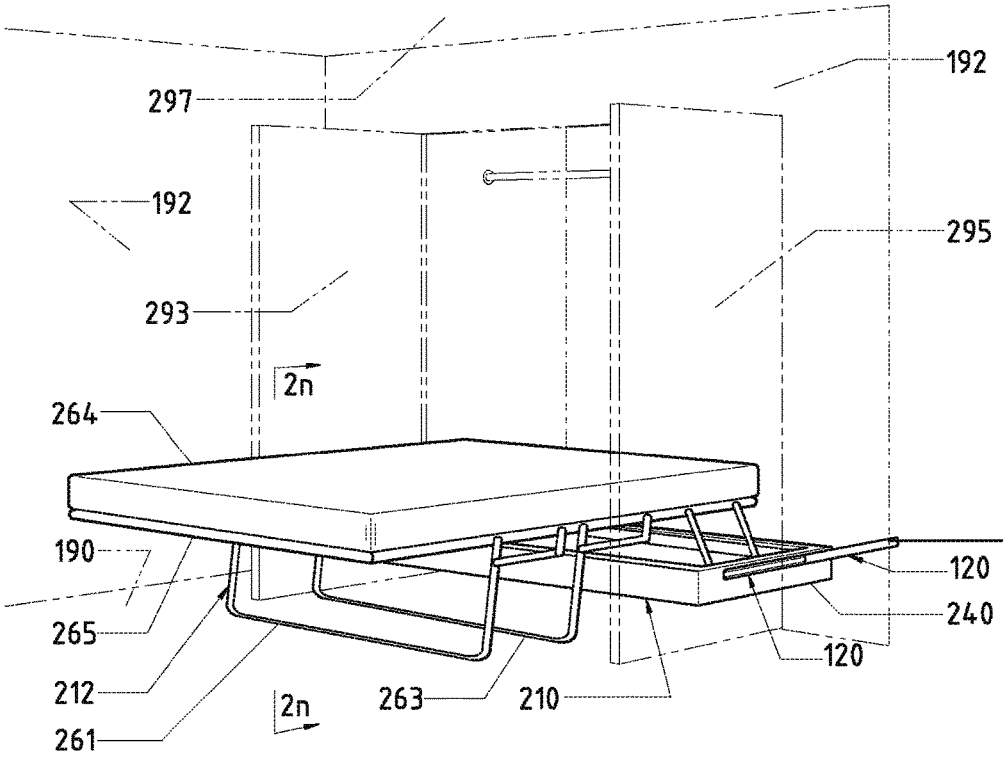

FIG. 2*m* is a perspective view of the same embodiment as FIG. 2*h*, but in the fully open position.

Figure 2N:
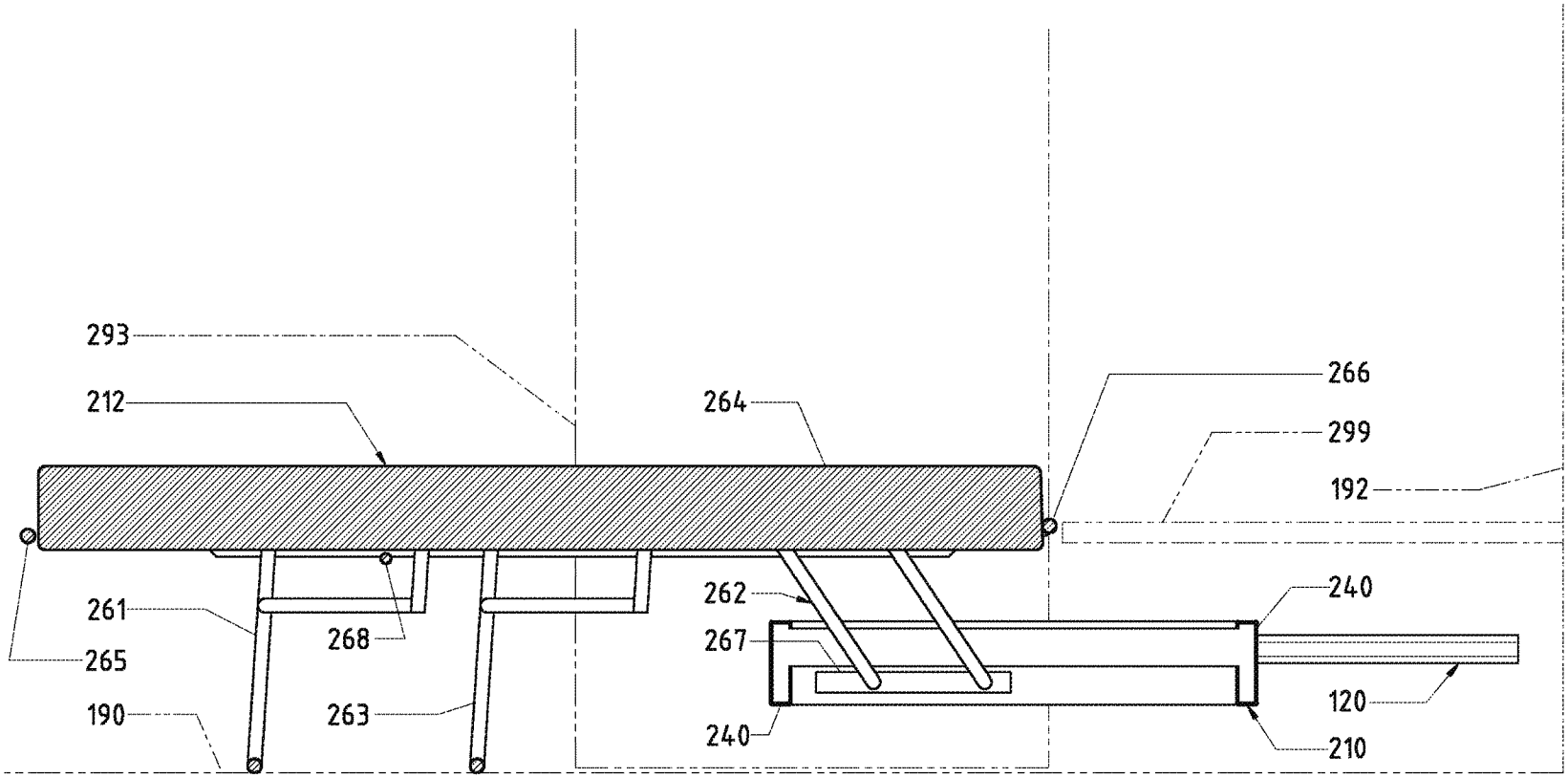
Figure 3A:
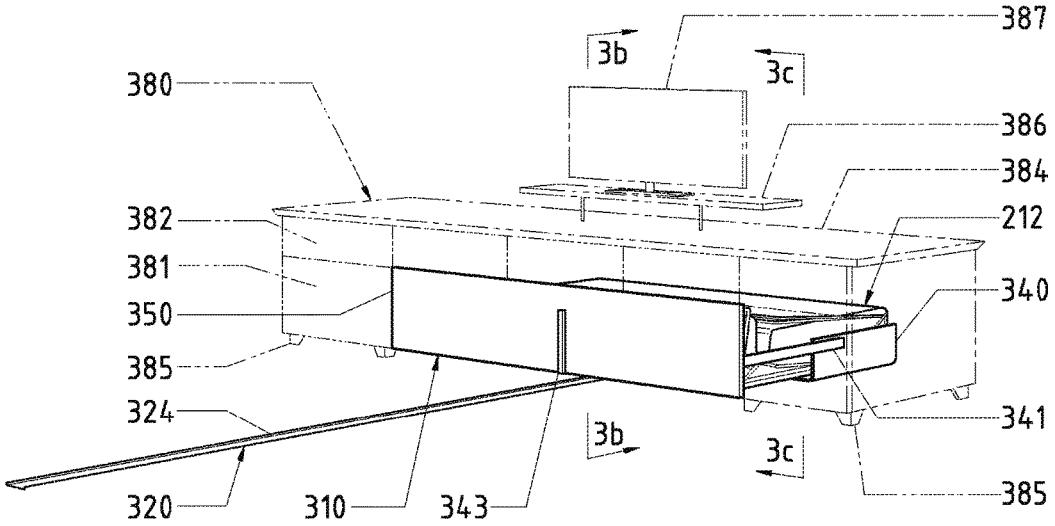

FIG. 2*n* is a sectional view the same embodiment as FIG. 2*h*, but in the fully open position FIG. 3*a* is a perspective view of a third embodiment of a concealable bed system, shown in the fully closed position.

Figure 3B:
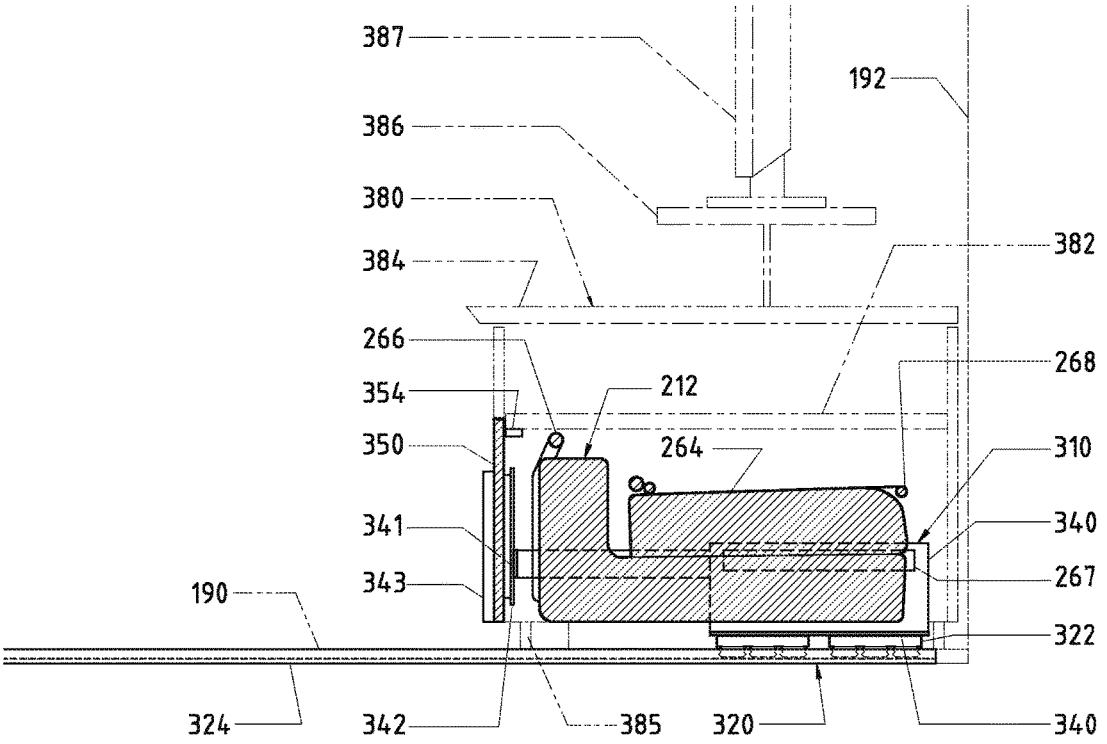

FIG. 3*b* is a sectional view of the same embodiment as FIG. 3*a*, also in the fully closed position.

Figure 3C:
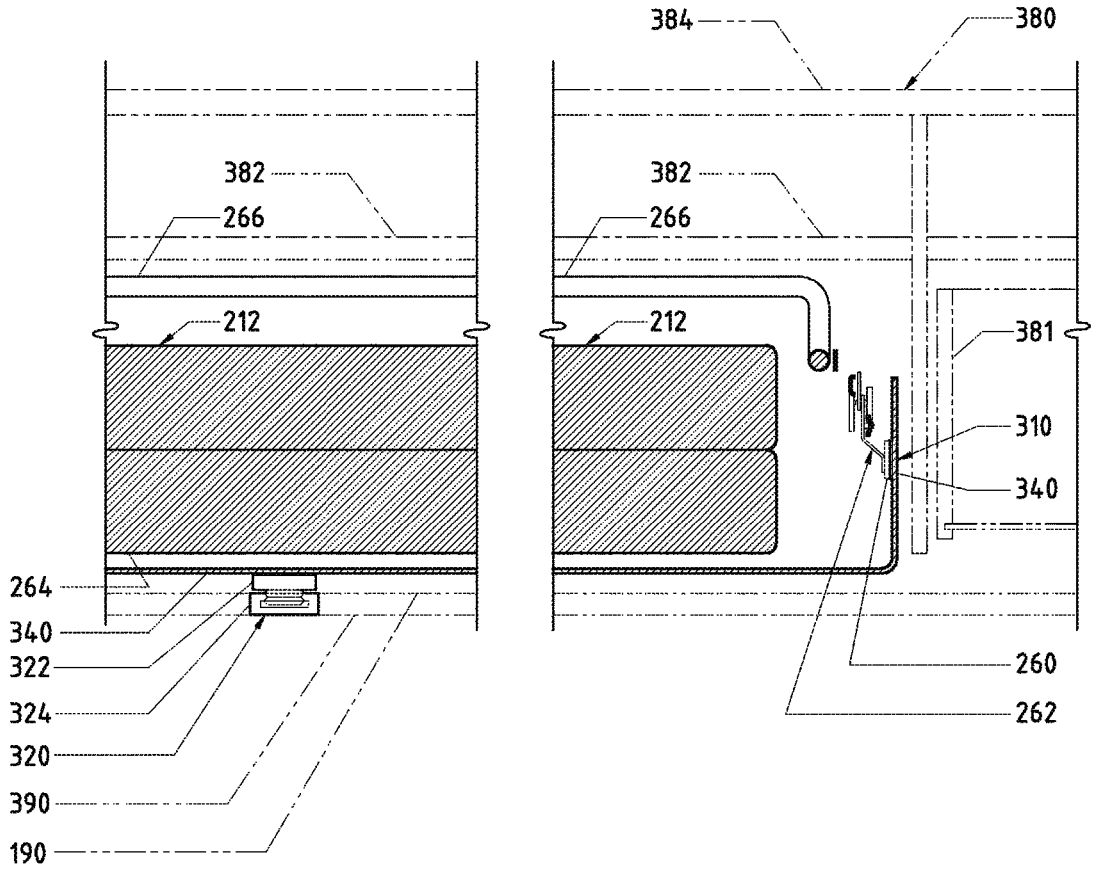

FIG. 3*c* is another sectional view of the same embodiment as FIG. 3*a*, also in the fully closed position.

Figure 3D:
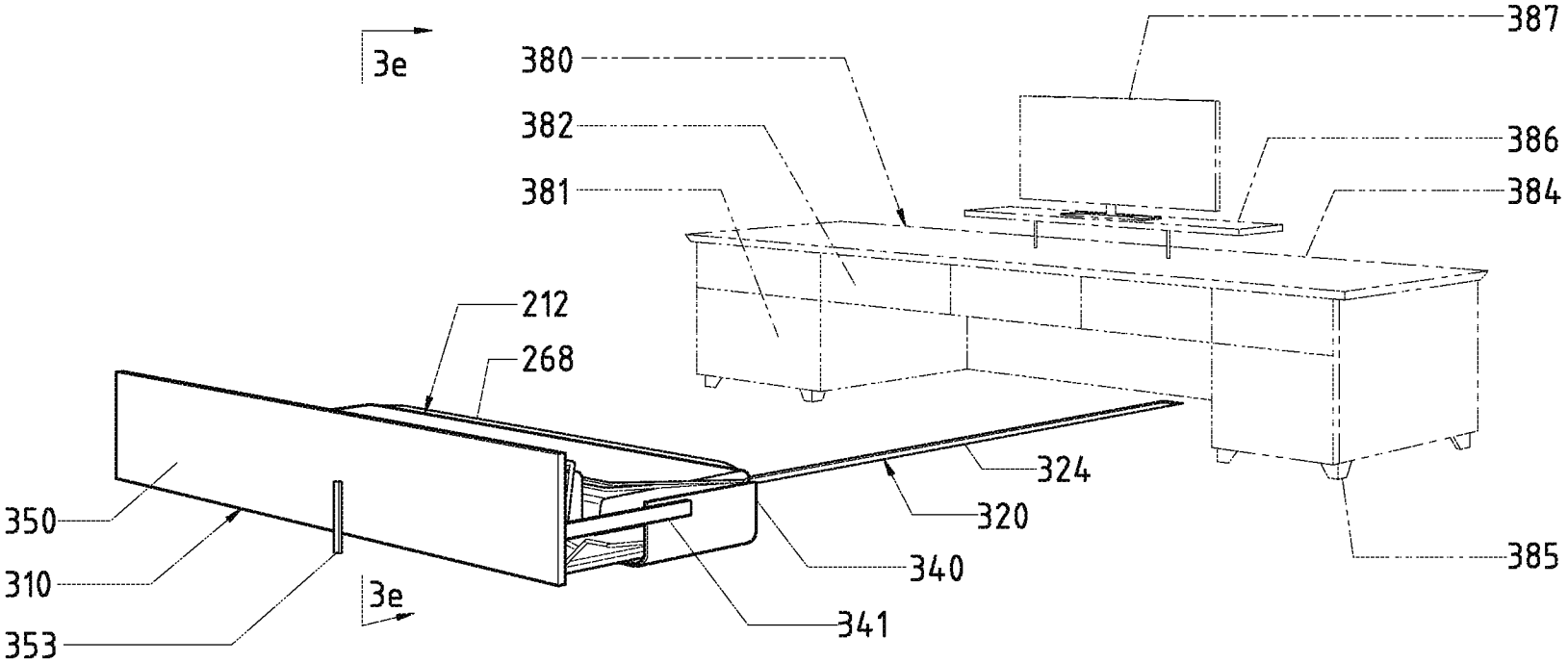

FIG. 3*d* is a perspective view of the same embodiment as FIG. 3*a*, but in the partially open position.

Figure 3E:
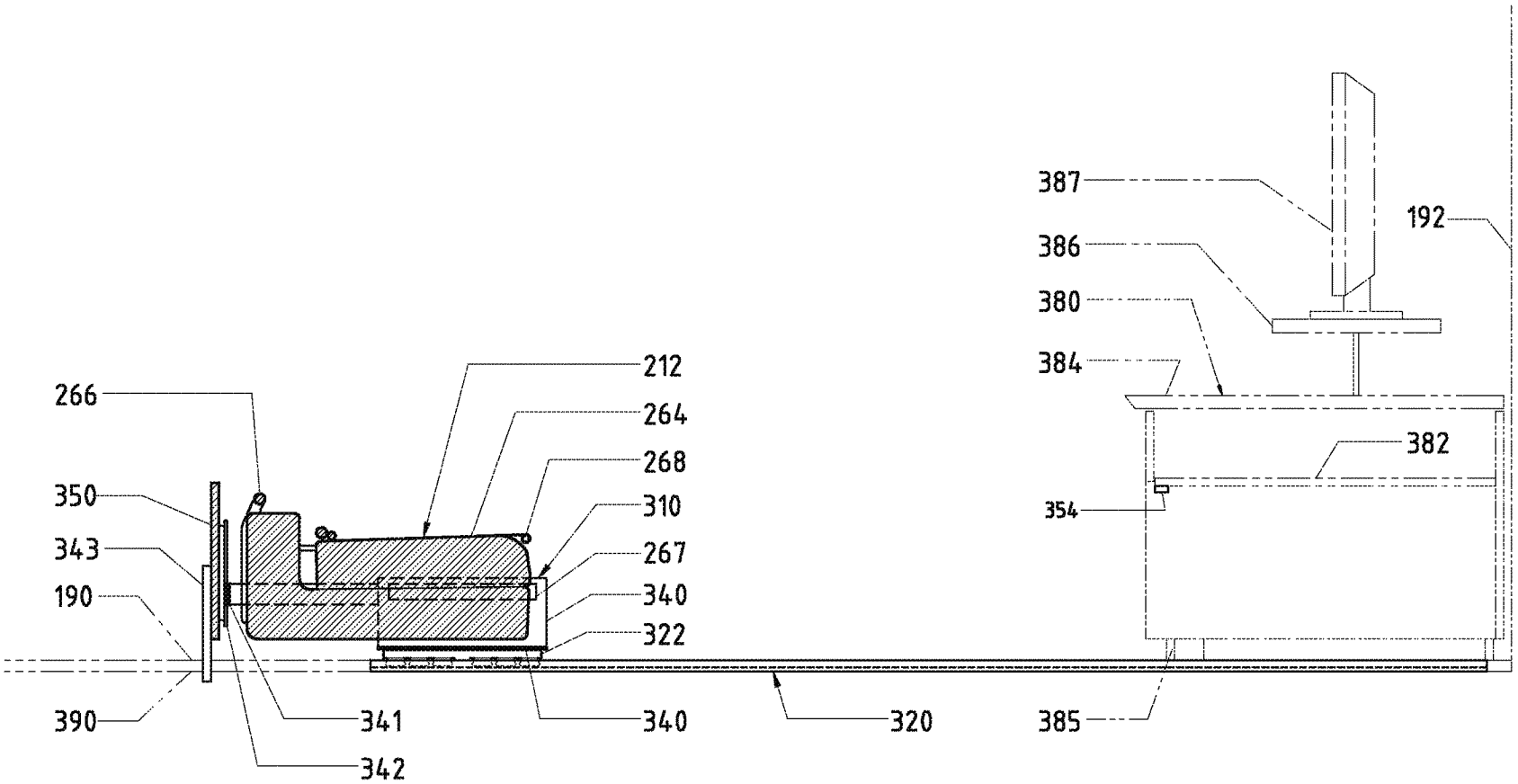

FIG. 3*e* is a sectional view of the same embodiment as FIG. 3*a*, but in the partially open position.

Figure 3F:
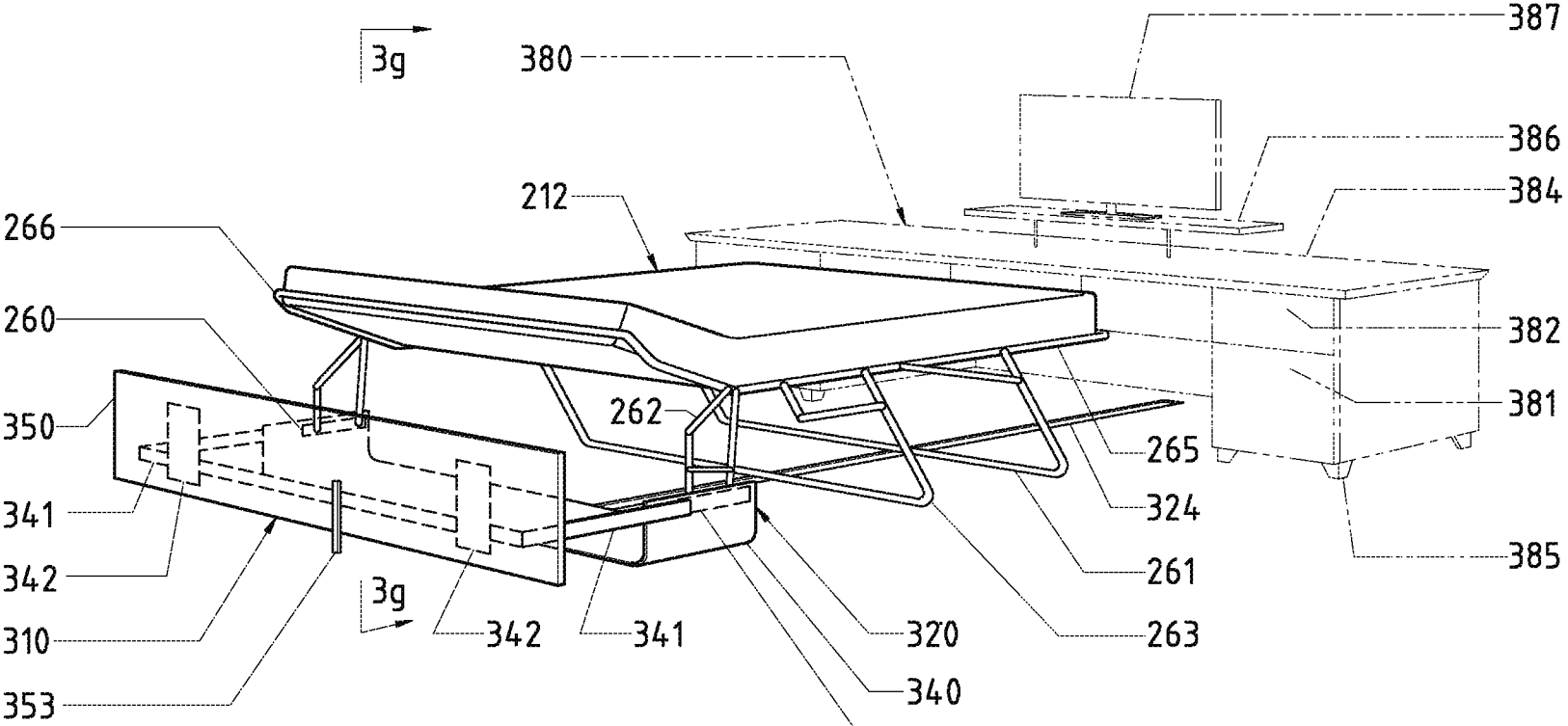

FIG. 3*f* is a perspective view of the same embodiment as FIG. 3*a*, but in the fully open position.

Figure 3G:
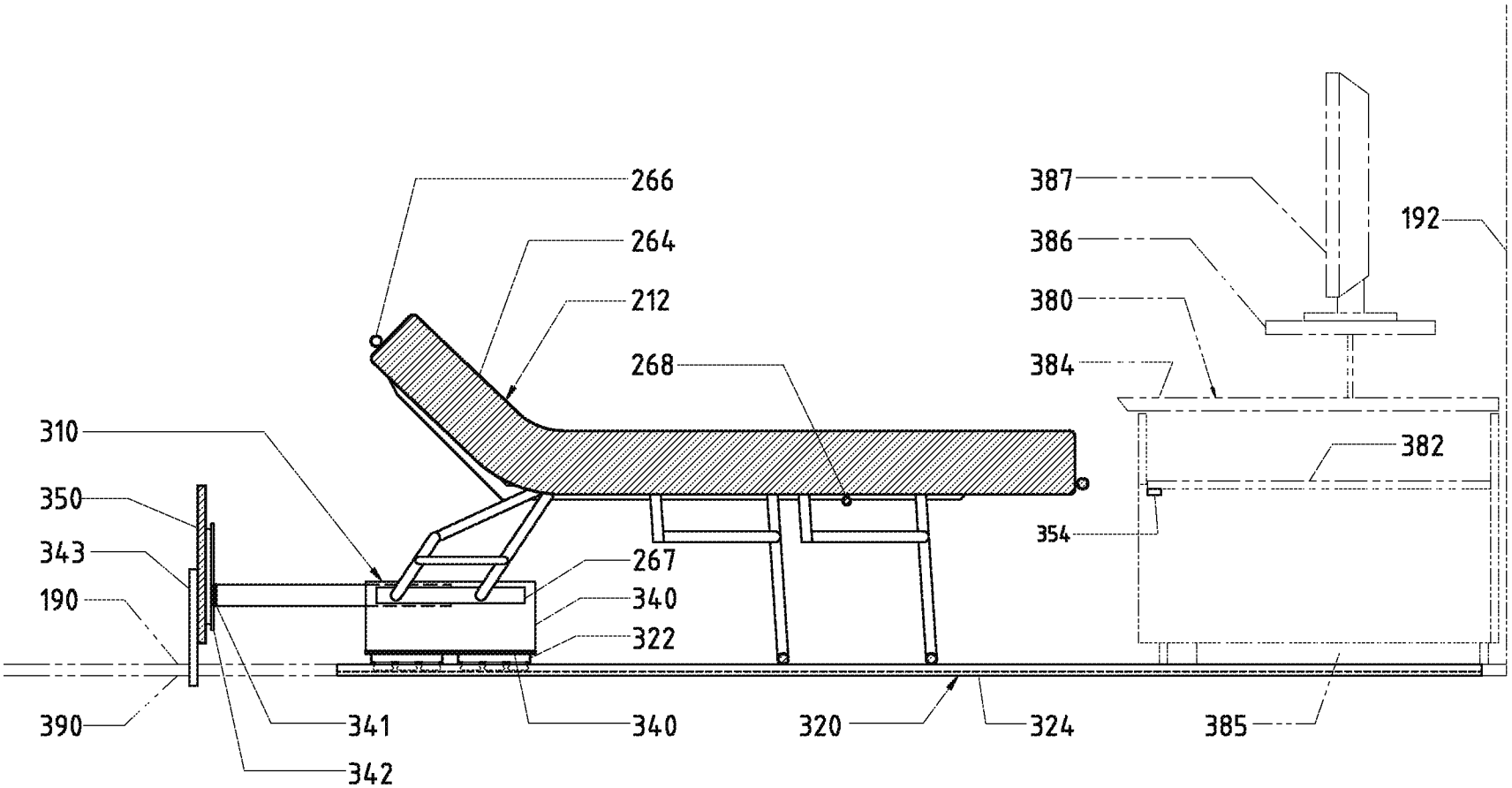

FIG. 3*g* is a sectional view the same embodiment as FIG. 3*a*, but in the fully open position

DETAILED DESCRIPTION

First Embodiment

FIGS. 1*a* through 1*g* show one embodiment of a concealable bed system that comprises a novel combination of a folding bed assembly 112, a drawer assembly 110, and a drawer support-and-control assembly 120.

In this embodiment, the concealable bed system is built into a cabinet carcase assembly 114. Uses for this embodiment include, but are not limited to, serving as one component of a modular furniture system (such as one might buy from Ikea or others); serving as one component of a closet organizer system (such as California Closets or others); or serving as one component of a kitchen cabinet system (possibly for a kitchen island or peninsula with a living area on one side). In the aforementioned systems, a consumer chooses from a menu of options such as "three-drawer cabinet," "base cabinet with door," or "open-shelving cabinet." An advantage of one or several aspects of this embodiment of a concealable bed system, if integrated into one of the aforementioned systems, is that it could become one more potential choice—the "bed cabinet" Other uses for this embodiment include, but are not limited to, its installation as a convenient, factory-produced "box" into adjacent construction that is site-built, such as partitions, custom cabinets, etc.

In this embodiment, the folding bed assembly 112 is LEGGETT & PLATT's "MODUMAX" 2300 series shallow frame sofa sleeper, 60" wide, with a 4" mattress, perhaps best seen in FIG. 1*f*. However, many other sizes, shapes, types, and designs of folding bed assemblies would also be suitable, such as, but not limited to, other commercially available models (such as LEGGETT & PLATT's CLASSICPLUS™, CLASSICSQUARE™, etc.), or the one described in U.S. Pat. No. 1,383,485 (Jul. 5, 1921), including subsequent improvements; or the one described in U.S. Pat. No. 3,416,168 (Dec. 17, 1968), including subsequent improvements; or the one described in U.S. Pat. No. 4,253,205 (Mar. 3, 1981), including subsequent improvements; or the one described in U.S. Pat. No. 4,509,216 (Apr. 9, 1985), including subsequent improvements; etc.

In this embodiment drawer assembly 110 comprises a generally rectangular, open-bottomed container with a finished face and a drawer pull. However, other types of sliding or movable containers, frames, or other supports for the bed, including those that lack one or several features commonly associated with drawers, would also be suitable. These include but are not limited to articles such as open steel frames, flat platforms without sides, or folding beds modified or designed for direct connection to a support-and-control assembly (in which case drawer assembly 110 might become one or several components, not necessarily contiguous, that are affixed to a folding bed). Similarly, in this embodiment the drawer assembly 110 comprises lengths of ¾" thick hardwood that are joined to form a substantially rigid box that is open on the top and the bottom, perhaps best seen in FIG. 1*d*. However, assembly 110 could also have a bottom and/or top, could comprise different types or cross sections of wood members, and/or could be constructed from other materials such as plywood, medium-density fiberboard, synthetics, etc. The drawer could also comprise a rigid metal frame of angles, tubes, plates, sheet metal, or members of many other shapes and cross sections.

In this embodiment, the drawer support-and-control assembly 120 comprises a pair of ACCURIDE #9307 side-mounted, heavy-duty, full-extension drawer slides with "lock-out" feature, perhaps best seen in FIG. 1*c*. However, the drawer support-and-control assembly 120 could also comprise many other drawer slides, including but not limited to under mount slides, center mount slides, etc.; it could comprise flanged casters in tracks, double-flanged casters on floor rails, linear guidance systems, etc.; and it could comprise non-contiguous elements such as latches, hold-opens, flush bolts, etc.

In FIG. 1*a* through FIG. 1*g*, phantom lines suggest a modular desk and drawer system 180 as adjacent construction, to illustrate one advantageous use of one or more aspects of this embodiment (in a home office, for example). However, this adjacent construction could also be a an entertainment center, a base cabinet, closets, partitions, or many other types of furniture or built-in construction.

Looking now more closely at the drawings, in FIG. 1*a* and FIG. 1*b*, the embodiment is shown closed, in which position it looks like any other drawer. These two views clearly show one advantage of this embodiment, which is that it forms a self-contained unit that can be used as a module in any type of surrounding construction. Phantom lines indicate one possibility for the adjacent construction and do not form part of the embodiment, including the modular desk system 180, drawer assemblies 181, a 2×4 wood front sleeper 186 and a 2×4 wood rear sleeper 188, a support rail 194, a floor 190, a wall 192, and a work surface 184.

Still looking at FIG. 1*a* and FIG. 1*b*, in this embodiment carcase assembly 114 comprises a ¾" plywood back panel 122 that is joined to ¾" plywood side panels 124 and 126 by continuous glued and screwed rabbet joints; the side and back panels are also joined to bottom panel 128 by continuous glued and screwed rabbet joints. The 1×4 hardwood front stiffener 130 and the 1×4 hardwood rear stiffener 132 are let into side panels 124 and 126, to which they are glued and screwed. Finally, 1×4 hardwood stretchers 134, 135, 136, and 137 are continuously rabbet jointed, glued, and screwed to the members below.

Although the preceding paragraph describes one method of constructing a carcase for this embodiment, other methods are also suitable, including but not limited to panels, stiffeners, and stretchers of different materials, sizes, and cross sections; other methods of joining the elements, such as but not limited to other wood joints or wood, metal, or synthetic fasteners, connector plates or angles, etc; or other configurations for the carcase, such as a full-width panel across the top in lieu of stretchers, replacing one or more panels with built-up frames, etc.

Still looking at FIG. 1*a* and FIG. 1*b*, in this embodiment a ¾" thick drawer face 150 and a ¾" thick fixed panel 152, both made of hardwood and finished to match the adjacent furniture system, organizer system, cabinets, etc., are screwed from the interior, hidden side to drawer assembly 110 and stiffener 130 respectively. However, other sizes, materials, cross sections, finishes, and connection methods of parts 150 and 152 would also be suitable. They also could be omitted entirely, by making a drawer box with a finished front panel 140, and by lengthening stiffener 130 and making it a finished panel as well. One advantage of the arrangement shown here, though, is that carcase assembly 114 and drawer assembly 142 can be constructed independently of the drawer face and fixed panel or, if desired, by a different manufacturer entirely. This would allow a furniture or cabinet manufacturer or wholesaler to simply buy a self-contained drawer-bed unit and apply their own finish panels, presumably ones that coordinate with their existing product lines. Drawer pull 154 is shown here as Colonial Bronze's #246 series appliance pull, 48" long. However, any other means of opening the drawer would also be suitable, including but not limited to any commercially available or custom pull or pressure latch, a finger pull provided in an edge or edges of drawer face 150, etc. It is also possible that the pull or pressure latch could be omitted, if the adjacent detailing permitted access to at least one edge of the drawer face.

FIG. 1*c*, is a partial longitudinal section through the embodiment, still in the closed position, looking toward the back. To illustrate the concealable bed system's modularity, phantom lines again indicate adjacent construction that is not part of the embodiment, including the desk system 180, drawers 181, work surface 184, and floor 190. Although a plurality of ordinary drawers are shown above and to the sides of the drawer bed, these adjacent units could also comprise shelves, file drawers, simple cubbies with doors, cutting boards, kitchen pantry systems, etc. In the arrangement shown here, the carcases for the drawers above the concealable bed system can simply be laid on top of carcase assembly 114, spanning between stretcher 134 and stretcher 136, and then minimally fastened to maintain alignment.

Still looking at FIG. 1*c*, in this embodiment the connection between folding bed assembly 112 and drawer assembly 110 occurs at steel mounting plates 160 and 167 (integral parts of the folding bed assembly) and the drawer box's side members 141 and 143, which in this embodiment are 1×8 hardwood (plate 167, the mirror image of plate 160, is visible in FIG. 1*g*.). Plates 160 and 167 are screwed to members 141 and 143 with a plurality of wood screws in accordance with the folding bed manufacturer's instructions.

To the left of plate 160 in FIG. 1*c* is assembly 162, which comprises a plurality of struts, pins, and other members that form part of the mechanism by which the bed folds and pivots into its stored position. This embodiment uses a commercially available folding bed assembly that is internally complete up to the point of its attachment, the details of these members are not described herein. For the same reason, the general position and shape of the bed's mattress 164 and the bed's head rail 166 are shown and noted, but are not further described.

Still looking at FIG. 1*c*, in this embodiment drawer assembly 110 is supported inside of carcase assembly 114 by drawer slide assembly 120, to which it is fastened with a plurality of wood screws in accordance with the slide manufacturer's instructions.

Turning now to FIG. 1*d* and FIG. 1*e*, the embodiment is shown in the partially open position, with drawer assembly 110 pulled forward to the limit permitted by drawer slide assembly 120. In this position, folding bed assembly 112 is exposed but still collapsed, providing a substantially horizontal surface onto which a seat cushion 182 could be placed (seat cushion 182, shown with phantom lines, is shown for reference and is not part of this embodiment.) This embodiment could thus be used as a temporary seating surface, but there is no requirement to do so—one can continue directly to deploying the bed if desired.

Still looking at FIG. 1*d* and FIG. 1*e*, note that carcase assembly 114 and fixed panel 152 have remained in the same position as in FIG. 1*a* and FIG. 1*b*. Bed assembly 112 has moved forward with drawer assembly 110, since it is fixed to the inside of the drawer as described above. In this position, the head of mattress 164 and the head rail 166 of the bed's frame are upturned behind stiffener 130 (in a sleeper sofa, these elements would extend up into the backrest).

Still looking at FIG. 1*d* and FIG. 1*e*, part of drawer assembly 110 is an assemblage comprising members 140, 141, 142, 143, 145, 146, 147, and 148. Members 140, 141, 142, and 143 are lengths 1×8 hardwood that are arranged to form a substantially rectangular frame, and are connected at the corners by continuous glued and screwed rabbet joints. This frame is in turn connected to flat 1×3 hardwood members 145, 146, 147, and 148, again by continuous glued and screwed rabbet joints. However, assemblages comprising members of many other materials, cross sections, and methods of connection would also be suitable.

Still looking at FIG. 1*d* and FIG. 1*e*, in this position the load of the now-cantilevered drawer assembly 110 will make carcase 114 tend to lift up off of sleeper 188, especially if persons are using this embodiment as a seating surface. For this reason, in this embodiment, carcase 114 is fastened to the adjacent construction through both bottom panel 128 and back panel 122 (in this case, to or through sleeper 188 and rail 194) with a plurality of lag bolts, metal screws, concrete anchors, adhesive, or other means of attachment suitable to the adjacent construction and sufficient for the imposed loads. However, other means for resisting the overturning of carcase 114 would also be suitable, including but not limited to mechanical or chemical fastening at side panels 124 and 126, the weight of more carcases or other construction on top of carcase 114, or reducing the tendency to overturn by changing the means of support of drawer assembly 110 (by, for example, supporting the entire drawer on casters, floor rails, etc.)

Looking now at FIG. 1*f* and FIG. 1*g*, the embodiment is shown in the fully open position. Drawer assembly 110, slide assembly 120, and carcase assembly 114 are in the same positions as shown in FIG. 1*d* and FIG. 1*e*, but bed assembly 112 is now unfolded and ready for use. Struts-and-pins assembly 162 is now extended and supports the head of the bed; this load is transferred through mounting plates 160 and 167 to hardwood members 141 and 143, thence to slide assembly 120, thence to carcase assembly 114, and thence to the adjacent construction. The bed is also supported by folding metal legs 161 and 163, which are connected to metal perimeter frame 165 with struts and pins. Legs 161 and 163, struts-and-pins assembly 162, mattress 164, and perimeter frame 165 are all components of a commercially-available folding bed assembly 112 (which is internally complete up to the point of its attachment), and so the details of these members are not further described herein.

Operation

To operate the embodiment of a concealable bed system described above, one approaches a closed drawer that is integrated into a desk, cabinet, or other article of furniture, or is integrated into a closet, millwork, wall, or other adjacent construction, in the mariner illustrated in FIG. 1*a*. One then opens the embodiment as he or she would any other drawer, by pulling it forward until it reaches its limit, as illustrated in FIG. 1*d*. In this embodiment, the lock-out feature of drawer slide assembly 120 will now automatically engage, holding the drawer in the open position until it is manually released. One reason that a means of holding the drawer in the open position is desirable is that folding bed assemblies can be awkward to operate if the drawer is free to slide back and forth. However, other methods of holding the drawer open would also be suitable, such as but not limited to cane bolts or latches that are received by side panels 124 and/or 126, removable armrests or nightstands that brace the drawer against finished panel 152, flush bolts that are mortised into drawer box front member 140 and are received by floor sockets, etc.

At this point the collapsed folding-bed assembly 112 is now exposed and accessible. If one chooses, one can lay cushions over the assembly and use the drawer as a seating surface. However, there is no requirement to do so one can continue directly to the bed function without first converting the embodiment to a sofa.

The folding bed can now be opened and deployed in a manner substantially familiar to anyone who has used a sleeper sofa. Namely, referring to FIG. 1*e*, one grasps foot rail 168 and uses it to lift bed assembly 112. This rotates the foot of bed assembly 112 up and forward, and tilts a substantial portion of the assembly at an angle of approximately 45 degrees from level. At the same time, the head of mattress 164 and head rail 166 rotate under stiffener 130 and fixed panel 152. As one continues to deploy the bed, it slides forward slightly on struts-and-pins assembly 162 (refer to FIG. 1*c*), so that the head of mattress 164 and head rail 166 slide out from under fixed panel 152.

One now presses down on foot rail 168, which rotates the head portion of the bed assembly back up again. Grasping folding leg 161, one pulls up and unfolds the foot portion of the bed; the assembly's plurality of struts and pivots cause the rear leg 163 to unfold automatically during this action. Once legs 161 and 163 reach the floor, mattress 164 has become substantially flat. The bed is now fully-opened and ready for use, as illustrated in FIG. 1*f*.

Although internally complex, folding bed assemblies like the one shown in this embodiment are quick and simple to operate, are familiar to anyone who has used a sleeper sofa (and therefore require no special instructions to use), and have been extensively debugged by their various manufacturers.

When one is finished using the bed or seating surface, one simply reverses the process so that the bed is once again concealed behind what appears to be an ordinary drawer face.

Additional Embodiments

Embodiment 1A

FIG. 1*h* and FIG. 1*i* show one or several variations of the first embodiment. In this version, all features are as previously described except for modifications related to switching folding bed assembly 112 to folding bed assembly 112*a*. Bed assembly 112*a* is also a LEGGETT & PLATT "MODUMAX" 2300 series shallow frame sofa sleeper with a 4" mattress, hut it is 40" wide (approximately the size of an American twin bed). Other aspects of the embodiment are modified to suit this new width (such as, but not necessarily limited to, the width of drawer assembly 110 and carcase assembly 114, the length of pull 154, etc.). The operation of bed assembly 112*a* is substantially similar to the operation of bed assembly 112, and there is a one-to-one correspondence between the part numbers shown for each. (For example, part 164*a* is the mattress of bed assembly 112*a*, and part 164 is the mattress of bed assembly 112.)

FIG. 1*h* shows the embodiment in the closed position, the same view as FIG. 1*b*. FIG. 1*i* shows the embodiment in the fully open position, the same view as FIG. 1*f*. Some advantageous uses of this narrower drawer-bed include, but are not limited to, installation in a teenager's bedroom, where it could be used for sleepovers, or in a small home office, where there isn't room for a larger bed, or in a master bedroom, as a place for a child to sleep when guests occupy a second bedroom, etc. This illustrates one advantage of one or several aspects of concealable bed systems—that with relatively simple dimensional adjustments, the various embodiments can accommodate a wide variety of sizes and types of commercially-available folding bed assemblies, allowing tremendous flexibility and adaptability.

Embodiment 1B

FIG. 1*k* through FIG. 1*q* show one or several variations of the first embodiment. In this version, all features are as previously described except for modifications related to changing drawer assembly 110 to drawer assembly 110*b*. In drawer assembly 110*b*, the wooden drawer box or container formed by parts 140 through 148 is omitted. Instead, mounting plates 160 and 167 (integral parts of folding bed assembly 112) are welded to interface plates 144*b* and 146*b*, which in this embodiment are 6"×13"×¼" steel plates (this detail is perhaps best seen in FIG. 1*m*, FIG. 1*p*, and FIG. 1*q*). Drawer slide assembly 120 is then fastened to interface plate 144*b* with a plurality of metal screws in accordance with the slide manufacturer's instructions. Other sizes, shapes, and materials would also be suitable for interface plates 144*b* and 146*b*, as would other means of attaching them to bed assembly 112 and drawer slide assembly 120. Modifying bed assembly 112 so that mounting plates 160 and 167 could connect directly to drawer slide assembly 120 would also be suitable.

Looking at FIG. 1*k* and FIG. 1*l*, this version of the embodiment looks substantially similar, from the outside, to the version shown in FIG. 1*a* and FIG. 1*b*. In this version, however, drawer face 150 is no longer attached to concealed member 140, which has been omitted. Instead, finished drawer face 150 is connected to carcase bottom panel 128 with piano hinge 142*b* (perhaps best seen in FIG. 1*o*). However, many other means of attaching drawer face 150 to carcase assembly 114 would also be suitable, including but not limited to a plurality of hinges, replacing drawer face 150 with a pair of side-hinged panels or sliding doors, etc. Modifying bed assembly 112 to accept direct attachment of a drawer face would also be suitable.

In this version of the embodiment, drawer assembly 110*b* comprises non-contiguous parts that do not form a container or continuous frame around bed assembly 112. However, many of the other features that one associates with "drawer" are present: the assembly slides forward out of an article of furniture, it has a finished face that coordinates with that article of furniture, it is used for storage, and it is connected to a drawer support-and-control assembly. As suggested above, other versions of this embodiment might treat other features of the drawer assembly as add-ons or integral parts of bed assembly 112.

To operate this version of the embodiment, one first opens drawer face 150 and rotates it downward, and then grasps the foot rail 168 of bed assembly 112 and pulls it forward. The rest of the operation continues as for the first embodiment.

Embodiment 2

FIGS. 2*a* through 2*g* show another embodiment of a concealable bed system that comprises a novel combination of a folding bed assembly 112, a drawer assembly 210, and a drawer support-and-control assembly 120.

Generally, this embodiment differs from that shown in FIG. 1*a* through FIG. 1*g* in that carcase assembly 114 has been eliminated, and drawer assembly 210 comprises an open metal frame in lieu of a wooden drawer box.

One advantageous use of one or several aspects of this embodiment is that it could be used in situations where a carcase is not desired. These include (but are not limited to) factory-built furniture that is sold as complete, singular units rather than as mix-and-match modules, custom furniture, custom cabinetry, site-built construction where more design freedom is desired, etc. This embodiment could, for example, be shipped to a manufacturer of bedroom dressers as an internally complete component, ready for inclusion in a line of "sleeper-dressers." Consumers could then choose between dressers with beds in them or dressers without, much as they currently choose between a sofa with a bed in it or a sofa without.

In FIG. 2*a* through FIG. 2*g*, phantom lines suggest an article of furniture 280 as adjacent construction, to illustrate one advantageous use of one or more aspects of this embodiment. (Articles like the one shown, which has drawers on both sides, are often used to separate a living area from a dining area or kitchen in open, loft-like spaces.) However, this adjacent construction could also be a an entertainment center, a base cabinet, closets, partitions, or many other types of furniture or built-in construction, In the following closer look at the drawings, only the differences with the first embodiment are described.

Looking at FIG. 2*a* and FIG. 2*b*, in this embodiment drawer assembly 210 comprises a one-piece, substantially rectangular metal frame 240 that surrounds bed assembly 112, and to which bed assembly 112, drawer slide assembly 120, and drawer face 150 are affixed. The frame 240 is a twelve gauge steel fabrication akin to those commonly produced for hollow metal door and window frames, with welded corners and slightly radiused edges. The cross section shown provides both structural strength and convenient surfaces on which to mount the bed and slides. However, frames of many other sizes, cross-sections, gauges, materials, methods of joining the corners, etc. would also be suitable.

Still looking at FIG. 2*a* and FIG. 2*b*, Phantom lines indicate one possibility for the adjacent article of furniture 280 and do not form part of the embodiment, including but not limited to a granite top 284, hardwood drawer assemblies 281 and 282, hardwood legs 285, 286, 287, and 288, and 2×6 flat hardwood rails 291 and 292. Floor 190 is also indicated for reference. In lieu of fixed panel 152, as shown in FIG. 1*a* through 1*g*, the finished face of drawer 282 is extended downward to cover the void at the bed's upturned mattress 164 and head rail 166, with the result that all of the drawers in the article of furniture appear to be the same height from the outside. The adjacent construction or article of furniture 280 could of course take many forms, as noted above; what is shown merely illustrates some ways for taking advantage of the design flexibility afforded by one or several aspects of this embodiment.

Looking now at FIG. 2*c*, the mounting plate 160, an integral part of bed assembly 112, would be connected to frame 240 with a plurality of thru-bolts in compression sleeves; frame 240 would in turn be connected to drawer slide assembly 120 by a plurality of metal screws. However, many other methods of attaching both the bed and the slides to frame 240 would also be suitable, including but not limited to metal screws for the bed, bolts for the slides, welds for either, etc. Phantom lines indicate an adjacent panel 291 (not part of the embodiment) that shows one method of supporting the fixed portion of slide assembly 120 inside a piece of stick-built furniture, but this could also be a partition, the side wall of a cabinet, etc.

Looking now at FIG. 2*d*. and FIG. 2*e*, drawer slide assembly 120 stops drawer assembly 210 before it hits the inside of the adjacent construction. With what is shown here, for example, this means that upturned mattress 164 and the bed's head rail 166 do not push on the back of the drawer face on drawer assembly 282, causing it to open inadvertently while deploying the bed.

FIG. 2*e* more clearly shows the nature of frame 240, which, as noted above, is a single four-sided part in this embodiment—like a hollow metal window frame laid flat. However, this part could also be fabricated in pieces, with attachment angles or other fastening at the corners. One possible advantage of such a version would be that the embodiment could be shipped as a kit for factory or field assembly.

FIG. 2*f* and FIG. 2*g* further illustrate this embodiment, in the fully open position.

Embodiment 2A

FIG. 2*h* through FIG. 2*n* show one or several variations of embodiment 2. In this version, all features are as previously described except that:

a) drawer face 150 and drawer pull 154 are omitted, b) folding bed assembly 112 is switched to folding bed assembly 212, and c) other modifications related to "a" and "b" above.

Folding bed assembly 212 is LEGGETT & PLATT's "CLASSIC SQUARE™" 3500 series square tubular sleep sofa, 60" wide, with a 6" mattress. The operation of folding bed assembly 212 is substantially similar to the operation of bed assembly 112, and there is a one-to-one correspondence between the part numbers shown for each. (For example, part 264 is the mattress of bed assembly 212, and part 164 is the mattress of bed assembly 112.)

One advantageous use of this version of the embodiment would be in situations where a drawer-bed was intended to be concealed behind other construction, such as in a closet, inside a bench with its own hinged finish panel, in a niche with its own door, etc. In FIG. 2*h* through FIG. 2*n*, phantom lines indicate a closet as one possibility for the adjacent construction.

In FIG. 2*h* and FIG. 2*i*, closet doors 293 and 295 are closed in front the embodiment, which would conceal it from view. Phantom lines also indicate, for reference, a floor 190, a wall 192, and a ceiling 297. In FIG. 2*i*, phantom lines also indicate a full-depth, full-width shelf 299.

In FIG. 2*j*, phantom lines indicate a double 2×12 ledger 290 affixed to wall 192, to illustrate one possible means of supporting drawer guide assembly 120. The ledger would also cause drawer slide assembly 120 to be located several inches away from the wall, which would allow drawer assembly 210 to fit between the butt edges of the open closet doors. As shown, the ledger is also used to support shelf 299.

Looking at FIG. 2*k* and FIG. 2*l*, phantom lines show open closet doors 293 and 295; the leading edge of frame 240 is thus revealed. To operate this version of this embodiment, a user would simply grip the top of frame 240 and tug, using it like a drawer pull.

Looking at FIG. 2*m* and FIG. 2*n*, bed assembly 212 is fully extended; the thicker mattress is now evident. Looking at FIG. 2*n*, the top of shelf 299 (which is not part of the embodiment is set at approximately 18" above floor 190. This allows plenty of room for the usual closet functions, including the hanging of wardrobe items. Although the adjacent construction could take many forms, this illustrates one advantage of one or several aspects of concealable bed systems over other concealed beds such as, but not limited to, Murphy beds.

Still looking at FIG. 2*n*, the minimal nature of drawer assembly 210 is apparent—the drawer has no separately finished drawer face, and there is no conventional five-sided drawer box. However, many of the features that one associates with "drawer" are present: the assembly comprises a substantially rectangular assemblage, it slides forward out of its own compartment, it is used for storage, and it is connected to a drawer support-and-control assembly Embodiment 3

FIGS. 3*a* through 3*g* show another embodiment of a concealable bed system that comprises a novel combination of a folding bed assembly 212, a drawer assembly 310, and a drawer support-and-control assembly 320.

In this embodiment, folding bed assembly 212 is LEGGETT & PLATT's "CLASSIC SQUARE™" 3500 series, as described relative to FIG. 2*h* through FIG. 2*n*.

In this embodiment, the bed support drawer assembly 310 comprises a bent steel tray that wraps under the bed and up both sides to support the mounting plates of bed assembly 212, and other bent steel parts to be further described shortly. However, drawer assembly 310 could also take other forms such as, but not limited to, tray or "skeleton" support systems of other sizes, materials, configurations, etc.

In this embodiment, the drawer support-and-control assembly 320 is BISHOP-WISECARVER Corporation's "UTILITRAK®" CR Series stainless steel carriage and channel assembly, size 3, with two UTCCA3-SS carriages arranged end-to-end, and a single channel approximately nine feet long. However, other floor-mounted linear guides would also be suitable, such as but not limited to dual-track configurations, more or custom carriages, other carriage-and-channel assemblies with components of different sizes, shapes, and materials, rail-and-caster systems, etc.

To further control drawer assembly 310, drawer support-and-control assembly 320 also includes pressure latch 354, an IVES CL12 "Invisible Latch," to hold the drawer closed. Pushing on drawer face 150 releases latch 354 and causes the drawer to spring open, so drawer pull 154 has been omitted here. Many other methods of holding the drawer closed, and opening it when desired, would also be suitable—including but not limited to many commercially available or custom magnetic latches, roller catches, ball catches, drawer pulls, etc.

To further control drawer assembly 320, drawer support-and-control assembly 320 also includes a manual surface bolt 343, an IVES SB1600M2 bolt with a 3½" throw, to hold the drawer in the open position. However, many other means of holding the drawer open would also be suitable, including but not limited to surface bolts of other sizes, materials, and throws; fully mortised bolts; automated latches, etc.

In this embodiment, phantom lines indicate one possibility for the adjacent construction—an entertainment center 380 comprising drawers 381, technology shelves with flip-down doors 382, a wood top 384, a television shelf 386, a television 387, and a plurality of legs 385. The importance of showing this adjacent construction for reference will become apparent upon further review of the drawings; however, this adjacent construction could also be a desk, dresser, partitions, etc.

Looking at FIG. 3*a* and FIG. 3*b*, bed assembly 212 has been rotated 180 degrees relative to the other embodiments discussed previously. Head rail 266 and the upturned section of mattress 264 are now oriented to the front of the drawer, and foot rail 268 and mounting plates 260 and 267 are to the rear. Floor track 324, part of carriage-and-track assembly 320, is set at the centerline of the embodiment and flush with the finished floor 190. Surface bolt 343 is set at the centerline of drawer face 350 and flush with its bottom edge. Pressure latch 354 is shown here mounted to the underside of shelf 382, which is not part of the embodiment. Depending on what form the adjacent construction takes, touch latch 354 could also be suitably located at the sides or bottom of the drawer face.

Looking at FIG. 3*c*, part 340 is a ¼" bent steel plate approximately 16" wide, formed into a long "U" or tray. This tray extends as one continuous piece of material from mounting plate 260 on one side of the bed to mounting plate 267 on the other side of the bed; it passes under the bottom of the bed without touching it. Mounting plates 260 and 267 are attached to tray 340 with a plurality of metal screws. Tray 340 is in turn supported along its centerline by two carriages 322, which are part of carriage-and-channel assembly 320. Channel 324 has protrusions on its inside faces that key into grooves on the wheels of carriages 322, resisting the tendency of the embodiment to tip (as a result of the eccentric load from bed assembly 212, see FIG. 3*b*). The top of channel 324 is set flush with finished floor 190. Here, the bottom of channel 324 is shown bearing on subfloor 390, but this will vary according to the nature of the adjacent construction. Phantom lines indicate technology shelf 382, adjacent drawer 381, and wood top 384 (all part of entertainment center 380) for reference.

Looking at FIG. 3*d*, drawer assembly 310 has now been slid along channel 324 to its limit, and manual surface bolt 353 has been engaged in a floor strike. Drawer face 350 is now approximately 90 inches from the drawer faces of entertainment center 380. Bed assembly 212 is still in its closed position. To continue deploying it, a user would walk around to the other side of drawer assembly 310, grasp foot rail 268, and pull the bed up and out towards the entertainment center, in the same manner described for the first embodiment.

Looking at FIG. 3*e*, part 341 is a 3"×¼" bent steel bar, forming a horizontal "U" that wraps continuously from one vertical leg of tray 340 to the other. Steel bar 341 is welded to the outside fixes of tray 340 (dashed lines indicate its position on the other side of bed assembly 212). Looking at FIG. 3*f*, mounting plates 342 are 10"×3"×⅛" flat steel bars welded to steel bar 341. Drawer face 350 is blind fastened with a plurality of wood screws, through shims, to mounting plates 342.

Still looking at FIG. 3*f*, folding bed assembly 212 is now fully opened. It has a tilt-up feature that raises the head of the mattress for lounging or watching television, which is the configuration shown here. Tray 340, "U"-shaped bar 341, mounting plates 342, and mounting plates 260 and 267 (integral parts of the bed assembly) are shown dashed where they lie behind other elements. Tray 340 is now empty—it contacts bed assembly 212 only at mounting plates 260 and 267, acting as a bridge element to carry the load down to carriage-and-channel system 320. (This is not intended to suggest that this is the only function of tray 340).

Looking at FIG. 3*f*, the skeletal nature of drawer assembly 310 is apparent. The drawer has no sides, no back, no top, and no bottom in the conventional sense, yet many of the features that one associates with "drawer" are present: the assembly slides forward out of a larger article of furniture, it can have a finished face that coordinates with that article of furniture, it is used for storage, and it is connected to a drawer support-and-control assembly.

Still looking at FIG. 3*f*, the relationship between folding bed assembly 212 and television 387 (not part of the embodiment) is apparent. This illustrates one advantageous use of one or several aspects of this embodiment, which is that it allows a concealable bed to be compactly stored under a television, while still allowing a person to watch that television when the bed is deployed. Possible uses for this embodiment include, but are not limited to, residential living areas, hotel suites, offices, etc., either in lieu of or as a supplement to a sleeper sofa.

Advantages

From the description above, a number of advantages of some embodiments of my concealable bed system become evident, including but not limited to the following:

a) it stores compactly, capable of providing a fill-sized or larger mattresses in low, shallow, efficient enclosure, which saves valuable closet space, furniture space, wall space, etc, for other uses.

b) it is simple to construct.

c) It is easy to use, requiring mere seconds and a minimum number of steps to go from the stored position to the fully deployed position.

d) It has a method of operation that is familiar to anyone who has used a sleeper sofa. For most embodiments, no special instructions are required. A user approaching a drawer-bed embodiment for the first time will immediately be able to deploy it, without having to fuss with unusual or highly customized features.

e) It can be modular and is highly adaptable, having the ability to be integrated into a wide variety of other constructions or assemblies. These include but are not limited to modular, mix-and-match furniture systems; factory-built furniture sold as complete, individual articles; custom shop-built furniture; custom cabinets or millwork; site-built millwork or partitions; closets; etc.

f) it uses many readily available, prefabricated parts and standard construction techniques. This not only contributes to its ease of use and construction, it will also help to limit malfunctions.

g) It is durable, not relying on inflatable mattresses or delicate, complex assemblies.

h) it expands the choices available for room layout and design, giving consumers another option in the field of concealable beds.

Conclusion, Ramifications, and Scope

Thus the reader will see that concealable bed systems of the various embodiments provide a markedly different and eminently useful addition to the current selection of concealable beds. They are compact, convenient, flexible, durable, can be installed in furniture other than sofas, take up far less wall space than Murphy beds, will be able to be used in rooms other than bedrooms, and will be both easier to use and less prone to malfunction than designs with unfamiliar methods of operation and/or a higher number of custom parts, While my above description contains many specificities, these should not be construed as limitations on the scope, but rather as an exemplification of one [or several] embodiments thereof. Many other variations are possible. For example, the drawer assembly could comprise a fiat platform without sides, or it could comprise a plurality of components integrated into or appended onto the folding bed assembly, or it comprise a different "skeletal" assemblage than the one described in Embodiment 3. The folding bed assembly could be of many different makes and models, and/or it could have a different method of operation than the one described. The drawer support-and-control assembly could comprise grooved casters that ride on floor rails, other types or configurations of floor-mounted linear guide systems, or other kinds of drawer slides.

Accordingly, the scope should be determined not by the embodiment(s) illustrate, but by the appended claims and their legal equivalents.

I claim:

1. A concealable bed assembly comprising:

a drawer assembly mounted within a cabinet carcase, the drawer assembly including two parallel longitudinal surface defining the length of the drawer assembly and two lateral surface defining the width of the drawer assembly;

a folding bed assembly mounted within the drawer assembly, the folding bed assembly including parallel longitudinal sides corresponding to the length of the drawer assembly and two lateral sides corresponding to the width of the drawer assembly;

a rail assembly attached to external longitudinal surfaces of the drawer assembly and to internal longitudinal surfaces of the cabinet carcase, the rail assembly providing for the drawer assembly to transition horizontally between a first position in which the drawer assembly is fully contained within the cabinet carcase and the folding bed assembly is fully contained within the drawer assembly and a second position in which the drawer assembly is at least partially outside the cabinet carcase and the folding bed assembly extends outward from the drawer assembly; and the rail assembly fully and solely supporting the drawer assembly in a cantilevered configuration with the cabinet carcase as it transitions horizontally between the first position and the second position.

2. The concealable bed assembly accordingly to claim 1, wherein the drawer assembly transitions horizontally through at least one access opening within the cabinet carcase.

3. The concealable bed assembly according to claim 2, wherein the drawer assembly is fully encompassed within the cabinet carcase in the first position and extends outward fully through the at least one access opening in the second position.

4. The concealable bed assembly according to claim 3, wherein the drawer assembly transitions between the first position and the second position directly and without any intermediate transitions by the cabinet carcase.

5. The concealable bed assembly according to claim 2, further comprising a face plate attached to the drawer assembly, the face plate dimensioned and positioned so as to fully encompass the at least one opening with the cabinet carcase.

6. The concealable bed assembly according to claim 5, further comprising a drawer pull attached to the face plate.

7. The concealable bed assembly according to claim 1, further comprising a set of posts attached to the one lateral side of the folding bed assembly furthers away from the cabinet carcase when in the second position, the set of posts being movable from a position parallel to the folding bed assembly to a position perpendicular to the folding bed assembly, the set of posts providing additional support to the folding bed assembly when the folding bed assembly extends fully outward from the drawer assembly in the second position.

* * * * *